US006445260B1

(12) United States Patent
Miyazaki et al.

(10) Patent No.: US 6,445,260 B1
(45) Date of Patent: Sep. 3, 2002

(54) POLARIZED WAVE SEPARATOR

(75) Inventors: Ryoko Miyazaki, Nishinomiya; Makoto Hirota, Kobe, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 17 days.

(21) Appl. No.: 09/715,258

(22) Filed: Nov. 20, 2000

(30) Foreign Application Priority Data

Nov. 22, 1999 (JP) ..... 11-330996
Aug. 22, 2000 (JP) ..... 2000-251375

(51) Int. Cl.[7] ..... H01P 1/16; H01Q 15/02
(52) U.S. Cl. ..... 333/21 A; 343/909
(58) Field of Search ..... 333/21 A, 248, 333/26, 125, 137; 343/909, 756, 775, 776–778

(56) References Cited

U.S. PATENT DOCUMENTS 4,959,658 A 9/1990 Collins
5,061,037 A 10/1991 Wong et al. ..... 385/11

FOREIGN PATENT DOCUMENTS

EP 0 928 040 7/1999
JP 60176302 9/1985
JP 4-271601 9/1992

OTHER PUBLICATIONS

Behe et al., "Compact Duplexer–Polarizer with Semicircular Waveguide", *IEEE Transactions on Antennas and Propagation*, 39(1991) Aug., No. 8, New York, US, pp. 1222–1224.

*Primary Examiner*—Robert Pascal
*Assistant Examiner*—Kimberly E Glenn
(74) *Attorney, Agent, or Firm*—Nixon & Vanderhye P.C.

(57) ABSTRACT

A pair of wave receiving probes is provided on opposite sides of an opening portion formed in a substrate. A waveguide is provided on one side of the substrate, and a wave reflecting unit is provided on the other side of the substrate. The wave reflecting unit is provided with a wave reflecting surface on an inner side of its end surface portion. A partition wall in a stepped pattern is provided in the waveguide, which penetrates the opening portion and extends to the end surface portion, thereby dividing the wave reflecting surface into two. The partition wall partitions the wave-guiding space formed by the waveguide, substrate and wave reflecting unit into two spaces. Accordingly, a polarized wave separator excellent in separating characteristics and preventing wave loss is realized.

17 Claims, 22 Drawing Sheets

POLARIZED WAVE SEPARATOR

BACKGROUND OF THE INVENTION

1. Field of the Invention

The present invention relates to polarized wave separators, and more particularly to a polarized wave separator for use in a receiving converter (a low noise blockdown converter, LNB) that receives radio wave from a broadcasting or communication satellite.

2. Description of the Background Art

Microwave being used in satellite broadcasting normally consists of two components. As typical microwave, circularly polarized wave includes clockwise polarized wave and counterclockwise polarized wave. Linearly polarized wave includes vertically polarized wave and horizontally polarized wave.

The receiving converter is required to efficiently separate such two components from each other, and a polarized wave separator is used for such separation of microwave. As a representative of conventional polarized wave separators for use in the receiving converters, a polarized wave separator for separating the components included in circularly polarized wave will now be described.

Referring to FIGS. 24 and 25, a pair of wave receiving probes 104*a,* 104*b* is formed on a substrate 103. A waveguide 101 is placed on one side of substrate 103. A waveguide partition wall 101*a* in a stepped shape is formed within waveguide 101, which partitions the interior of waveguide 101 into two portions.

A wave reflecting unit 102 is placed on the other side of substrate 103. A wave reflecting unit partition wall 102*a* is formed within wave reflecting unit 102, which partitions the interior thereof into two portions. A wave reflecting surface 102*b* is formed on an end surface of wave reflecting unit 102 opposite to substrate 103.

On a surface of substrate 103 facing wave reflecting unit 102, an earthed surface (pattern) 105 is formed along end surfaces of wave reflecting unit 102 and its partition wall 102*a* such that they contact with each other. On the other surface of substrate 103 facing waveguide 101, another earthed surface (not shown) is formed along end surfaces of waveguide 101 and its partition wall 101*a* such that they contact with each other.

The earthed surface 105 for contact with wave reflecting unit 102 and the earthed surface for contact with waveguide 101 are electrically connected to each other via a through hole 106. Thus, waveguide 101 and wave reflecting unit 102 are both maintained at an earth potential via substrate 103.

The pair of wave receiving probes 104*a,* 104*b* is formed on substrate 103 on its side facing wave reflecting unit 102. Interconnection portions of wave receiving probes 104*a,* 104*b* are electrically isolated from any of earthed surface 105, wave receiving unit 102 and waveguide 101.

Waveguide partition wall 101*a* and wave reflecting unit partition wall 102*a* act to partition the interior of waveguide 101 and wave reflecting unit 102, respectively, into two wave-guiding spaces. Circularly polarized wave caught within waveguide 101 is separated by waveguide partition wall 101*a* and introduced into respective wave-guiding spaces.

The conventional polarized wave separators have configurations as described above.

With such a conventional polarized wave separator, however, there exist several problems conceivable as follows. To prevent the wave within waveguide 101 and wave reflecting unit 102 from externally escaping, or to reduce noise, it is necessary to ensure that respective end surfaces of partition walls 101*a,* 102*a,* waveguide 101 and wave reflecting unit 102 contact their corresponding earthed surfaces.

If the secure contact between wave reflecting unit partition wall 102*a* and earthed surface 105 on substrate 103 is ensured, however, good contact between the end surface of waveguide 101 and the corresponding earthed surface may not be achieved.

As a result, the wave may escape from waveguide 101, or the wave may not be separated successfully.

In addition, since wave reflecting unit 102 and waveguide 101 are electrically connected to each other via substrate 103, there may arise a problem that the wave introduced into waveguide 101 will be attenuated by substrate 103 before reaching wave reflecting surface 102*b,* which results in further weakening of the wave. Hereinafter, such reduction in strength of the wave due to escape and/or attenuation will be referred to as "wave loss".

SUMMARY OF THE INVENTION

The present invention is directed to solve the conceivable problems as described above. An object of the present invention is to provide a polarized wave separator that ensures separation of radio wave while suppressing escape of the wave, thereby reducing the wave loss.

A polarized wave separator according to the present invention includes a substrate portion, a pair of wave receiving portions, a waveguide, and a wave reflecting unit. The substrate has an opening portion. The pair of wave receiving portions is formed on the substrate on opposite sides in a radial direction of the opening portion. The waveguide is located on one side of the substrate portion, and has a partition wall portion provided therein. The wave reflecting unit is located on the other side of the substrate portion, and has a wave reflecting surface formed on its inner side. The waveguide, substrate portion and wave reflecting unit together form a wave-guiding space. The partition wall portion extends through the opening portion to the wave reflecting unit, and divides the wave reflecting surface into two portions. By the partition wall, the wave-guiding space is partitioned into two spaces, one in which one of the pair of wave receiving portions is located and the other in which the other of the pair of wave receiving portions is located.

According to this polarized wave separator, compared to the case of a conventional polarized wave separator in which the waveguide and the wave reflecting unit are located on respective sides of the substrate portion with no opening therein, the wave-guiding space formed by the waveguide, substrate and wave reflecting unit is partitioned by the single partition wall penetrating the opening formed on the substrate. Therefore, the separated wave caught in the respective wave-guiding spaces is prevented from escaping from one wave-guiding space to the other wave-guiding space both in the waveguide and in the wave reflecting unit near the substrate portion. This improves polarized wave-separating characteristics. In addition, the wave guided in the wave-guiding spaces is propagated to the wave reflecting surface without being interrupted by the substrate portion. This reduces the wave loss. Furthermore, the substrate portion is contacted only by the tubular portion of the wave reflecting unit and the waveguide, so that they both can make good contact with the substrate. Thus, it is possible to prevent the separated wave from escaping outside the waveguide or the tubular portion, so that the wave loss can be reduced.

Preferably, the waveguide is located such that the internal circumference of the waveguide encircles the opening portion. The wave reflecting unit includes the tubular portion that is located on the other side of the substrate portion from the waveguide, and an end surface portion that is located on an end of the tubular portion where a wave reflecting surface is formed. The partition wall portion contacts at least the end surface portion, so that it is electrically connected with the wave reflecting unit.

With such a configuration, conduction between the partition wall portion and the wave reflecting unit is ensured, so that the loss of the separated wave is alleviated. Further, it is possible to prevent escape of the separated wave from one wave-guiding space to the other wave-guiding space at least through a gap between the partition wall portion and the end surface portion, so that the separating characteristics are further improved.

To ensure that the partition wall portion and the wave reflecting unit are electrically connected in a good condition and the wave is prevented from escaping as described above, the following configurations are desirable.

The end portion of the partition portion facing the wave reflecting surface is preferably in a convex shape, and this convex shaped end portion contacts the wave reflecting surface.

Preferably, a groove portion is formed on an inner side of the end surface portion of the wave reflecting unit, so that the end portion of the partition wall portion facing the wave reflecting surface is accepted in the groove portion. In particular, it is desired that the end portion of the partition wall portion is in a saw-tooth waveform or a waveform, and the groove portion is formed in a shape corresponding thereto. This assures the contact between the partition wall portion and the wave reflecting unit.

Still preferably, the end surface portion of the wave reflecting unit is provided with a female screw portion and a male screw portion mounted onto the female screw portion, and the male screw portion contacts the partition wall portion.

Preferably, a slit portion is formed on the end surface portion which penetrates the end surface portion, and the end portion of the partition wall portion facing the wave reflecting surface is inserted into the slit portion.

Still preferably, the end portion of the partition wall portion penetrates the slit portion and is riveted at the outside of the end surface portion.

Preferably, a conductive member is mounted between the end portion of the partition wall portion and the slit portion. The conductive member preferably includes an elastic body or a resin.

Still preferably, the end portion of the partition wall portion penetrates the slit portion and is exposed at the end surface portion, and a conductive member is formed to directly cover the end surface portion and the exposed end portion. The conductive member preferably includes a conductive film, metal foil, conductive paste or conductive adhesive.

Preferably, the end portion of the partition wall portion penetrates the slit portion and is exposed at the end surface portion, and the end surface portion and the exposed end portion are welded.

Still preferably, the partition wall portion contacts the tubular portion, and at the portion where the tubular portion and the partition wall portion contact with each other, a concave portion is provided to either one of the tubular portion and the partition wall portion that is formed along a direction in which the partition wall portion extends, and a convex portion is provided to the other of the tubular portion and the partition wall portion that is fitted into the concave portion.

Preferably, a conductive, earthed cap portion is provided between the partition wall portion and the slit portion to cover the end portion.

In this case, provision of such earthed cap portion ensures that the partition wall portion and the end portion are electrically conducted to each other.

Preferably, the earthed cap portion includes a side portion that is formed towards a direction in which the partition wall portion extends, and a cut and bent portion that is bent towards the slit portion side or towards the partition wall portion side.

In this case, the cut and bent portion further ensures the electrical conduction between the partition wall portion and the end surface portion, and also prevents the earthed cap portion from falling off.

Still preferably, the earthed cap portion includes a hooked portion that closely contacts the wave reflecting surface of the end surface portion.

In this case, by the hooked portion in close contact with the wave reflecting surface, the earthed cap portion is secured on the wave reflecting surface, so that it is reliably mounted in the slit portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

A polarized wave separator being used in a converter for receiving microwave according to the first embodiment will now be described.

Figure 1:
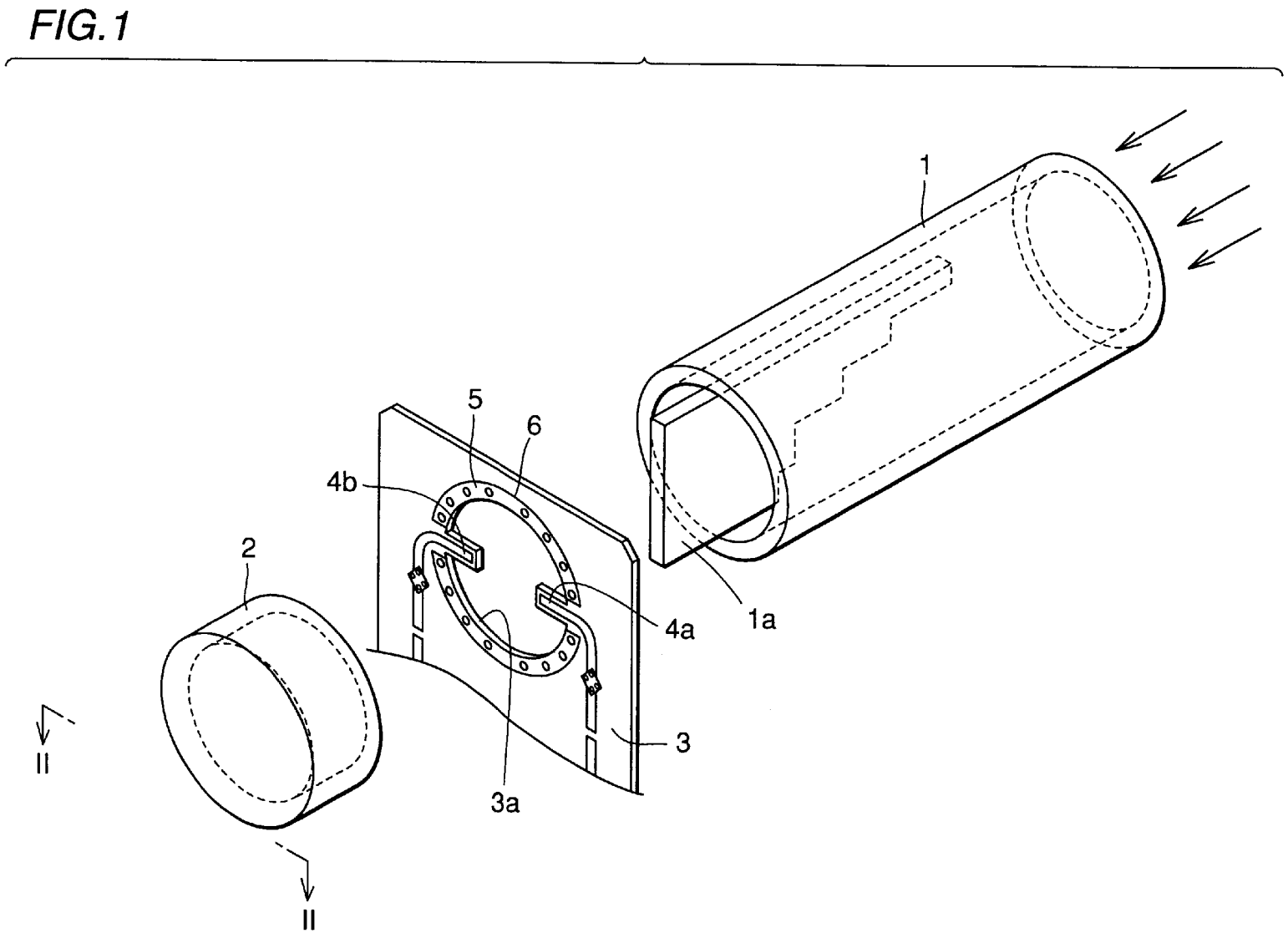
FIG. 1 is a perspective view of a polarized wave separator before assembly according to a first embodiment of the present invention.
Figure 2:
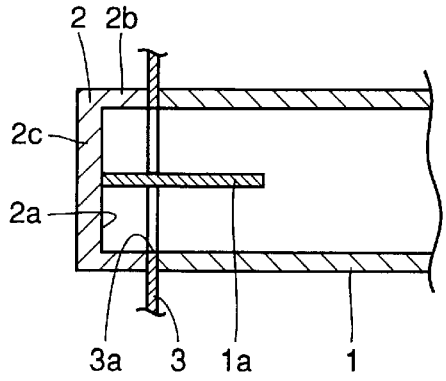
FIG. 2 is a cross sectional view taken along a line II—II of FIG. 1.

Referring to FIGS. 1 and 2, an opening portion 3*a* is formed in a substrate 3. A pair of wave receiving probes 4*a*, 4*b* is also formed on substrate 3, on opposite sides of opening portion 3*a*. The pair of wave receiving probes 4*a*, 4*b* is formed on a surface of substrate 3 facing a wave reflecting unit 2, as will be described later. Substrate 3 is, for example, a Teflon substrate or a glass epoxy substrate.

A waveguide 1 is located on one side of substrate 3, and arranged so that one end of waveguide 1 encircles opening portion 3*a* as well as the pair of wave receiving probes 4*a*, 4*b*.

Wave reflecting unit 2 is located on the other side of substrate 3, and arranged so that one end of a tubular portion 2*b* of wave reflecting unit 2 encircles opening portion 3*a* and the pair of wave receiving probes 4*a*, 4*b*. An end surface portion 2*c* is provided on the other end of tubular portion 2*b*. A wave reflecting surface 2*a* is formed on an inner side of end surface portion 2*c*, opposite to the pair of wave receiving probes 4*a*, 4*b*.

On a surface of substrate 3 facing wave reflecting unit 2, an earthed surface (pattern) 5 is formed along the end surface of tubular portion 2*b* such that they contact with each other. Similarly, an earthed surface (not shown) is formed on the other surface of substrate 3 facing waveguide 1, along the end surface of waveguide 1. The earthed surface and the end surface of waveguide 1 are arranged to contact with each other.

Earthed surface 5 in contact with tubular portion 2*b* of wave reflecting unit 2 and the earthed surface in contact with waveguide 1 are electrically connected to each other via a through hole 6. Thus, waveguide 1 and wave reflecting unit 2 are both held at an earth potential via substrate 3. Interconnection portions of wave receiving probes 4*a*, 4*b* formed on substrate 3 are electrically isolated from wave reflecting unit 2 and waveguide 1.

A partition wall 1*a* in a stepped form is provided within waveguide 1. Partition wall 1*a* extends through opening portion 3*a* to reach end surface portion 2*c*. An end portion of partition wall 1*a* facing wave reflecting surface 2*a* partitions the wave reflecting surface 2*a* into two portions. Partition wall 1*a* and waveguide 1 are formed in an integrated form by, e.g., aluminum die-casting.

A wave-guiding space formed by waveguide 1, substrate 3 and tubular portion 2*b* is partitioned by partition wall 1*a* into two spaces. One wave-guiding space has one of the pair of wave receiving probes 4*a*, 4*b* located therein, and the other wave-guiding space has the other of the pair of wave receiving probes 4*a*, 4*b* located therein.

An operation of the polarized wave separator described above will now be explained.

In the case where microwave is circularly polarized wave, the circularly polarized wave introduced into waveguide 1 is transformed to linearly polarized wave by means of partition wall 1*a* of the stepped shape. As the circularly polarized wave includes clockwise polarized wave and counterclockwise polarized wave, the transformed, linearly polarized wave includes a component transformed from the clockwise polarized wave and a component transformed from the counterclockwise polarized wave.

Of the two wave-guiding spaces partitioned by partition wall 1*a*, one wave-guiding space (wave-guiding space A) catches the component of linearly polarized wave (component A) that was transformed from the clockwise polarized wave, and the other wave-guiding space (wave-guiding space B) catches the component of linearly polarized wave (component B) that was transformed from the counterclockwise polarized wave.

Thus separated component A travels through opening portion 3*a* to reach wave reflecting surface 2*a*, where it is reflected by wave reflecting surface 2*a* and received at one of the pair of wave receiving probes 4*a*, 4*b*. Similarly, component B is received at the other probe.

Respective components A, B of the linearly polarized wave received at the pair of wave receiving probes 4*a*, 4*b* are input into a prescribed circuit (not shown) of the converter.

Figure 24:
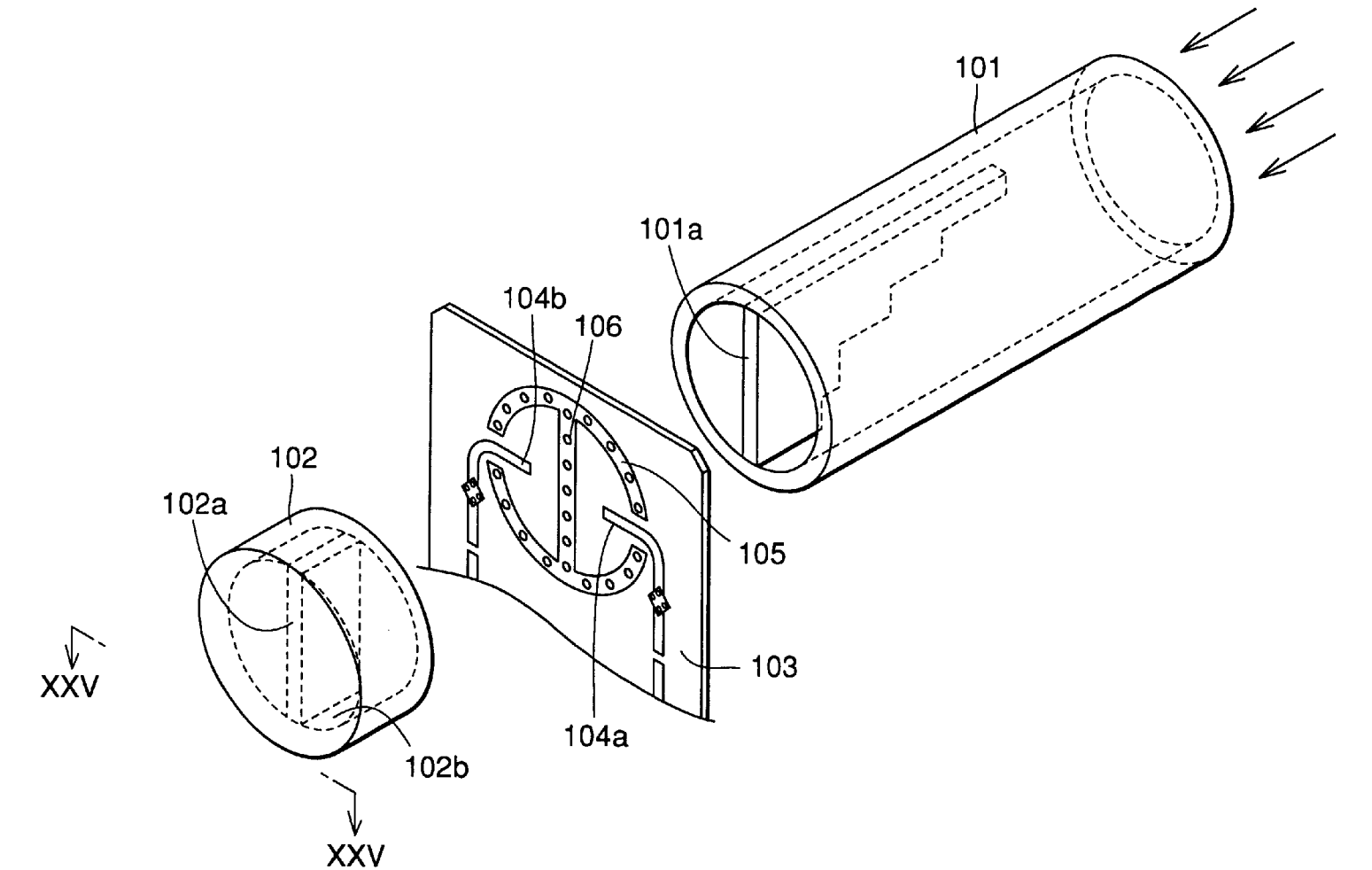
FIG.24 PRIOR ART
FIG. 24 is a perspective view of a conventional polarized wave separator before assembly.
Figure 25:
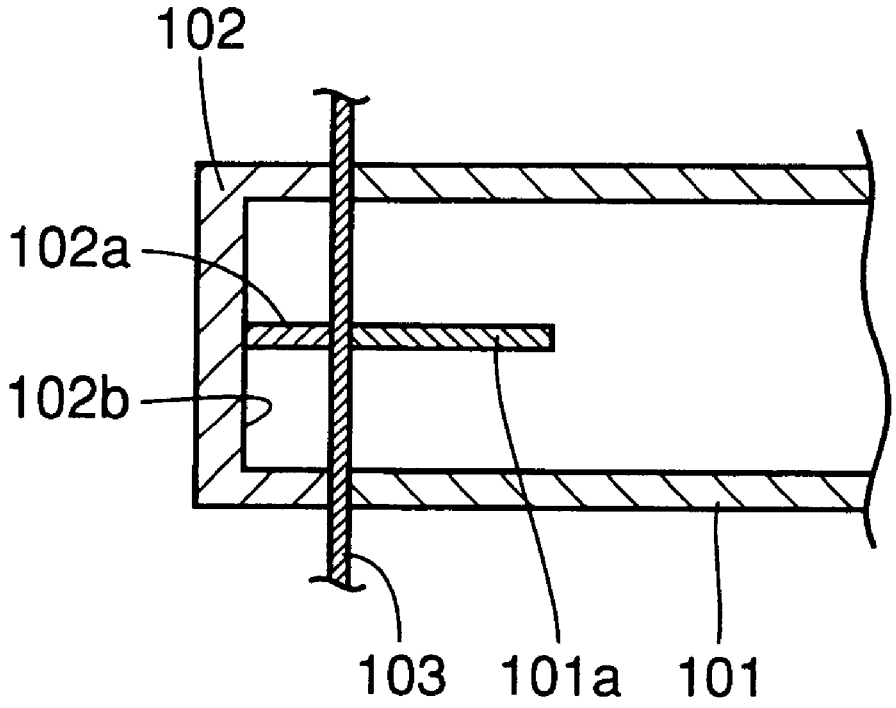
FIG.25 PRIOR ART
FIG. 25 is a partial, sectional view taken along a line XXV—XXV of FIG. 24.

As shown in FIGS. 24 and 25, different from the case of the conventional polarized wave separator in which partition walls 101*a*, 102*a* were provided on respective sides of substrate 103, the above-described polarized wave separator includes substrate 3 having opening portion 3*a*, and partition wall 1*a* extends through opening portion 3*a* to reach end surface portion 2*c*. Accordingly, the disadvantage of the prior art that poor contact between respective partition walls and the substrate results in escape of the separated wave from one wave-guiding space to the other is prevented, thereby improving polarized wave-separating characteristics.

Further, substrate 3 is contacted only by opposing tubular portion 2 of wave reflecting unit 2 and waveguide 1, and wave reflecting unit 2 and waveguide 1 are both ensured to attain better contact with surface 3. Thus, the wave is prevented from escaping outside waveguide 1 or wave reflecting unit 2.

Still further, two components A, B separated by partition wall 1*a* are propagated to wave reflecting surface 2*a* without being interrupted by substrate 3. Thus, the wave loss is reduced.

Second Embodiment

Figure 3B:
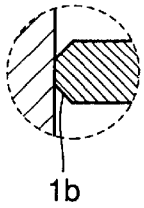
FIG. 3B is a partial, enlarged sectional view of the polarized wave separator of FIG. 3A.
Figure 3A:
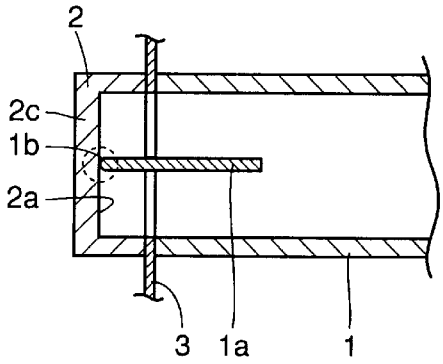
FIG. 3A is a partial, vertical sectional view of a polarized wave separator according to a second embodiment of the present invention.
Figure 3C:
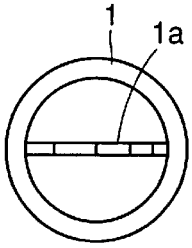
FIG. 3C is a side view of the polarized wave separator of FIG. 3A.

A polarized wave separator according to the second embodiment will now be described with reference to FIGS. 3A, 3B and 3C. Specifically, an end portion 1*b* of partition wall 1*a* facing wave reflecting surface 2*a* is in a convex shape, and the narrowed portion contacts wave reflecting surface 2*a*. Otherwise, the configuration of the polarized wave separator according to the present embodiment is identical to that of the first embodiment shown in FIGS. 1 and 2, and therefore, same members are denoted by same reference characters and description thereof is not repeated.

According to the polarized wave separator of the present embodiment, contact of the convex end portion 1*b* of partition wall 1*a* with wave reflecting surface 2*a* ensures conduction between partition wall 1*a* and wave reflecting unit 2. Thus, loss of the separated wave is reduced, and escape of the components of the linearly polarized wave from one wave-guiding space A or B to the other wave-guiding space B or A is also restricted. As a result, polarized wave-separating characteristics for microwave are improved.

Third Embodiment

Figure 4B:
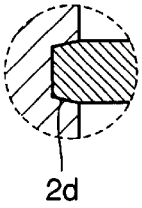
FIG. 4B is a partial, enlarged sectional view of the polarized wave separator of FIG. 4A.
Figure 4A:
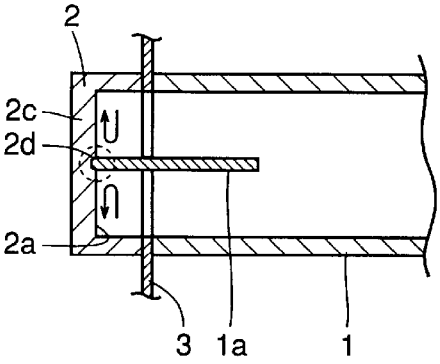
FIG. 4A is a partial, vertical sectional view of a polarized wave separator according to a third embodiment of the present invention.
Figure 4C:
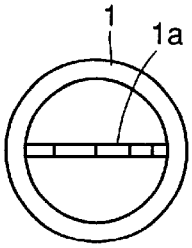
FIG. 4C is a side view of the polarized wave separator of FIG. 4A.

A polarized wave separator according to the third embodiment will now be described. Referring to FIGS. 4A, 4B and 4C, a groove 2*d* is formed on the inner side of the end surface portion 2*c* of wave reflecting unit 2. This groove 2*d* accepts the end portion of partition wall 1*a* facing wave reflecting surface 2*a*. Otherwise, the configuration of the polarized wave separator according to the present embodiment is identical to that of the first embodiment shown in FIGS. 1 and 2, and therefore, same members are denoted by same reference characters and detailed description thereof is not repeated.

According to the polarized wave separator of the present embodiment, the end portion of partition wall 1*a* is received at groove 2*d* formed on end surface portion 2*c*, thereby ensuring separation between wave-guiding space A and wave-guiding space B. Thus, the components of the transformed, linearly polarized wave are prevented from escaping from one wave-guiding space A or B to the other wave-guiding space B or A. As a result, the polarized wave-separating characteristics for microwave are further improved.

Figure 5A:
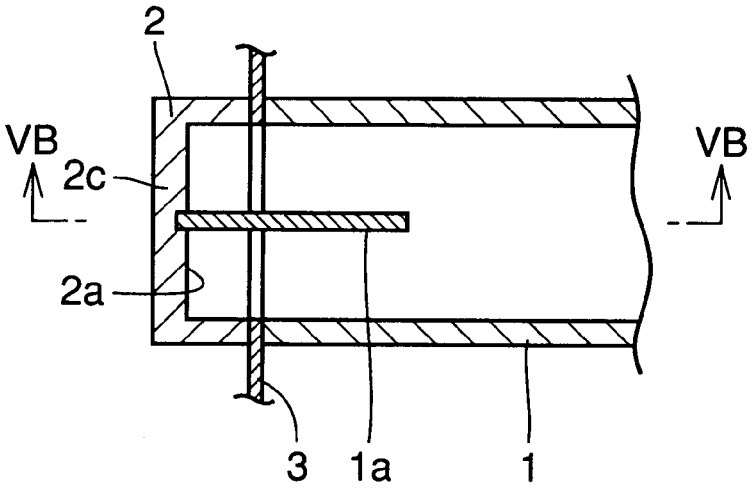
FIG. 5A is a partial, vertical sectional view of a polarized wave separator according to a fourth embodiment of the present invention.
Figure 5B:
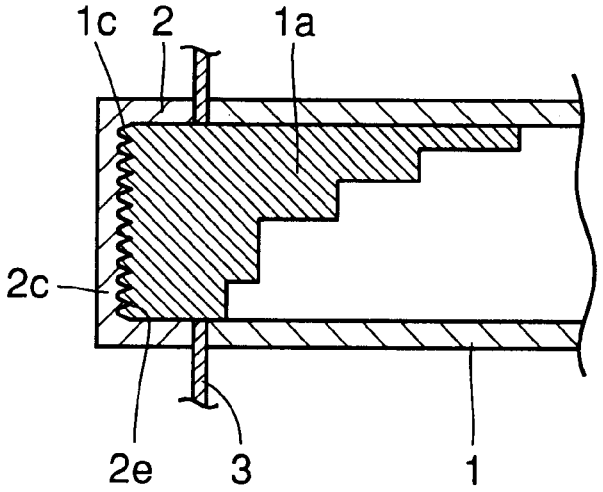
FIG. 5B is a partial, sectional view taken along a line VB—VB of FIG. 5A.
Figure 5C:
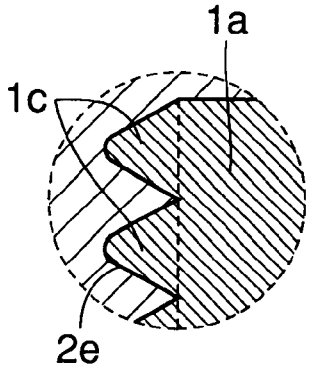
FIG. 5C is a partial, enlarged sectional view of the polarized wave separator of FIG. 5A.

Fourth Embodiment A polarized wave separator according to the fourth embodiment will now be described. Referring to FIGS. 5A, 5B and 5C, a groove 2*e* is formed on the inner side of end surface portion 2*c* of wave reflecting unit 2. This groove 2*e* receives an end portion 1*c* of partition wall 1*a* facing wave reflecting surface 2*a*. End portion 1*c* has an irregular shape in a saw-tooth waveform. Groove 2*e* has an irregular shape in a saw-tooth waveform corresponding to the form of end portion 1*c*. Otherwise, the configuration of the polarized wave separator according to the present embodiment is identical to that of the first embodiment shown in FIGS. 1 and 2, so that same members are denoted by same reference characters and detailed description thereof is not repeated.

According to the polarized wave separator of the present embodiment, the irregular shape in the saw-tooth waveform of end portion 1*c* of partition wall 1*a* matches the irregular shape in the saw-tooth waveform of groove 2*e* of end surface portion 2*c*. Thus, contact, and hence conduction, between partition wall 1*a* and wave reflecting unit 2 is ensured. Correspondingly, loss of the separated wave is reduced, wave-guiding spaces A and B are reliably separated from each other, so that escape of components of the transformed, linearly polarized wave from one wave-guiding space A or B to the other is prevented. As a result, the polarized wave-separating characteristics for microwave are still further improved.

Figure 5D:
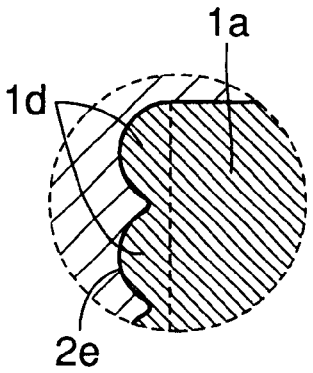
FIG. 5D is a partial, enlarged sectional view of a modification of the polarized wave separator of FIG. 5A.

It is noted that, as shown in FIG. 5D, end portion 1*c* having the irregular shape in the saw-tooth waveform can be replaced by an end portion 1*d* having an irregular shape in a waveform, and groove 2*e* can be shaped corresponding to the waveform. Even in such a case, the same effects as in the case with the saw-tooth waveform can be obtained.

Fifth Embodiment

Figure 6B:
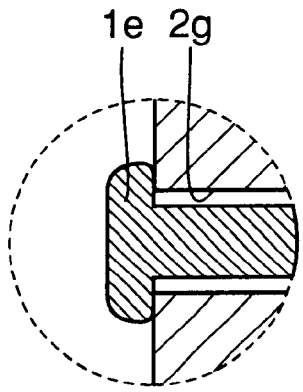
FIG. 6B is a partial, enlarged sectional view of the polarized wave separator of FIG. 6A.
Figure 6A:
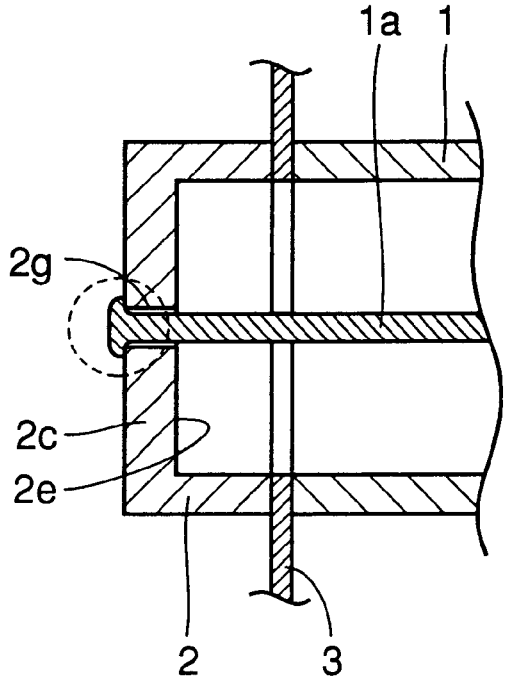
FIG. 6A is a partial, vertical sectional view of a polarized wave separator according to a fifth embodiment of the present invention.

A polarized wave separator according to the fifth embodiment will now be described. Referring to FIGS. 6A and 6B, end surface portion 2*c* of wave reflecting unit 2 is provided with a slit 2*g* penetrating therethrough. The end portion of partition wall 1*a* facing wave reflecting surface 2*a* is inserted into slit 2*g*, and riveted at the outside of end surface portion 2*c*, so that a riveted portion 1*e* is provided. Otherwise, the configuration of the polarized wave separator of the present embodiment is identical to that of the first embodiment shown in FIGS. 1 and 2, and therefore, same members are denoted by same reference characters and description thereof is not repeated.

According to the polarized wave separator of the present embodiment, the end portion of partition wall 1*a* is inserted into slit 2*g*, and riveted at the outside of end surface portion 2*c* to provide riveted portion 1*e*. Therefore, contact between partition wall 1*a* and wave reflecting unit 2 is ensured, providing good conduction therebetween. Correspondingly, loss of the separated wave is reduced, separation between wave-guiding spaces A and B is ensured, and escape of components of the transformed, linearly polarized wave from one wave-guiding space A or B to the other wave-guiding space B or A is prevented. As a result, the polarized wave-separating characteristics for microwave are further improved.

Figure 6C:
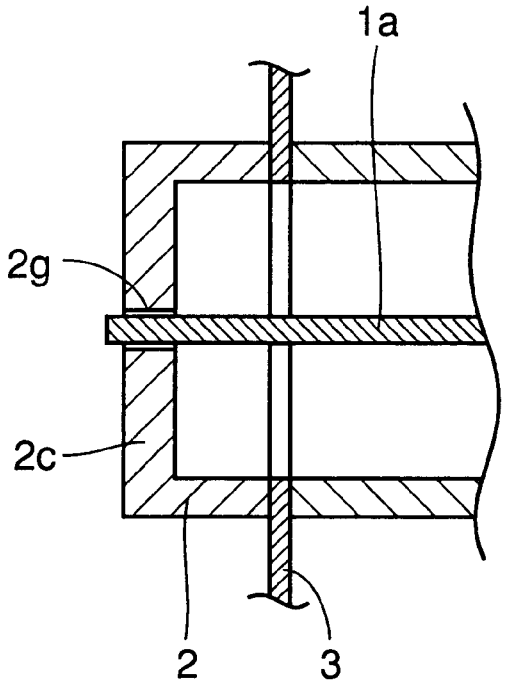
FIG. 6C is a partial, vertical sectional view of the polarized wave separator of FIG. 6A before formation of a riveted portion.

Riveted portion 1*e* can be readily formed by inserting the end portion of partition wall 1*a* into slit 2*g* and riveting the portion protruding from end surface portion 2*c*, as shown in FIG. 6C.

Sixth Embodiment

Figure 7A:
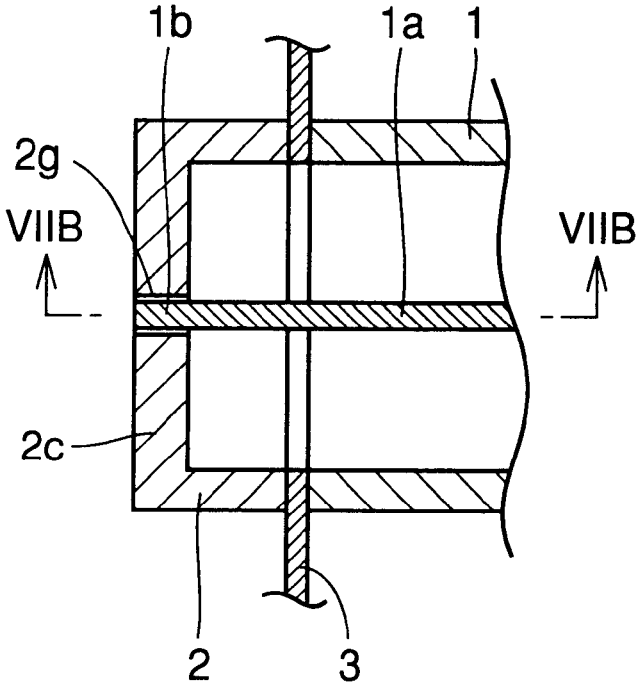
FIG. 7A is a partial, vertical sectional view of a polarized wave separator according to a sixth embodiment of the present invention.
Figure 7C:
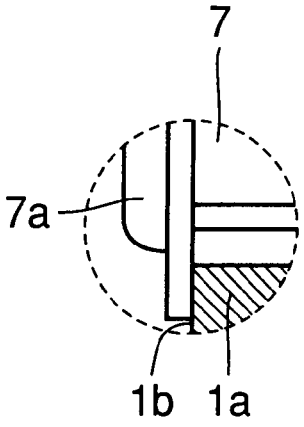
FIG. 7C is a partial, enlarged sectional view of the polarized wave separator of FIG. 7A.
Figure 7B:
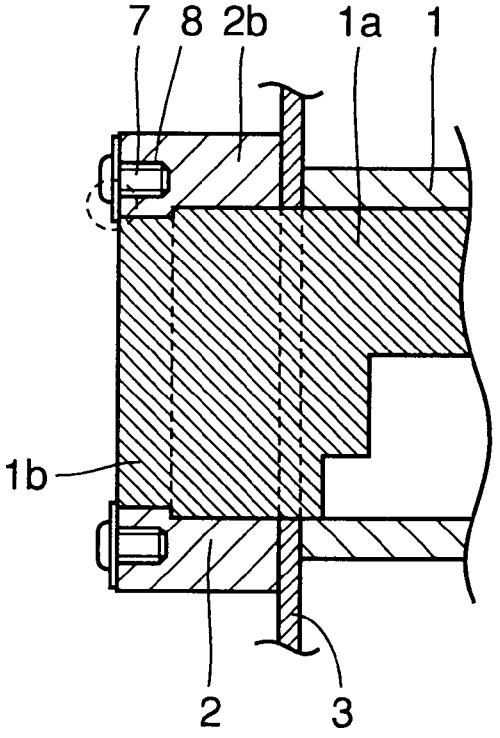
FIG. 7B is a partial, sectional view taken along a line VIIB—VIIB of FIG. 7A.

A polarized wave separator according to the sixth embodiment will now be described. Referring to FIGS. 7A, 7B and 7C, a slit 2*g* is formed which penetrates end surface portion 2*c* of wave reflecting unit 2. An end portion 1*b* of partition wall 1*a* facing wave reflecting surface 2*a* is inserted into slit 2*g* and is exposed from end surface portion 2*c*. In addition, at a portion of tubular portion 2*b* of wave reflecting unit 2 in contact with partition wall 1*a*, a tapped hole 8 is provided along a direction in which partition wall 1*a* extends, and a screw 7 is provided in tapped hole 8. A screw head 7*a* of screw 7 contacts end portion 1*b* of partition wall 1*a*.

Otherwise, the configuration of the polarized wave separator of the present embodiment is similar to that of the first embodiment shown in FIGS. 1 and 2, and therefore, same members are denoted by same reference characters and description thereof is not repeated.

According to the polarized wave separator of the present embodiment, end portion 1*b* of partition wall 1*a* is exposed outside the end surface portion 2*c* of wave reflecting unit 2, and screw head 7*a* of screw 7 attached to wave reflecting unit 2 contacts the exposed end portion 1*b*. Thus, connection between partition wall 1*a* and wave reflecting unit 2 is ensured, providing good conduction therebetween. Correspondingly, loss of the separated wave is reduced, separation of wave-guiding spaces A and B is assured, so that components of the transformed, linearly polarized wave are prevented from escaping from wave-guiding space A to wave-guiding space B or vice versa. As a result, the polarized wave-separating characteristics for microwave are further improved.

In addition, the use of the screw ensures conduction between partition wall 1*a* and wave reflecting unit 2, while preventing variation in dimension of parts or variation in assembling work.

Seventh Embodiment

Figure 8A:
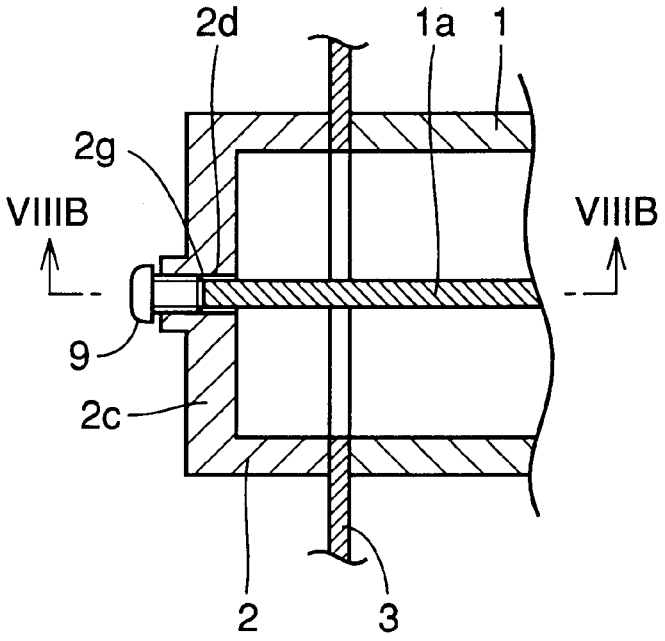
FIG. 8A is a partial, vertical sectional view of a polarized wave separator according to a seventh embodiment of the present invention.
Figure 8C:
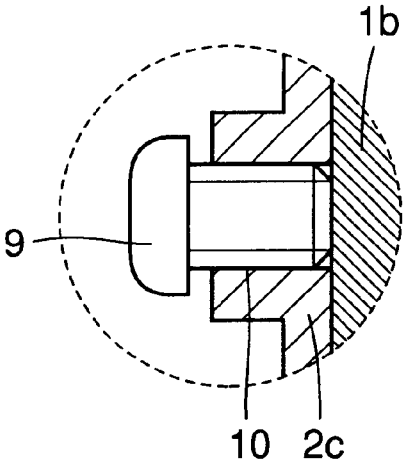
FIG. 8C is a partial, enlarged sectional view of the polarized wave separator of FIG. 8A.
Figure 8B:
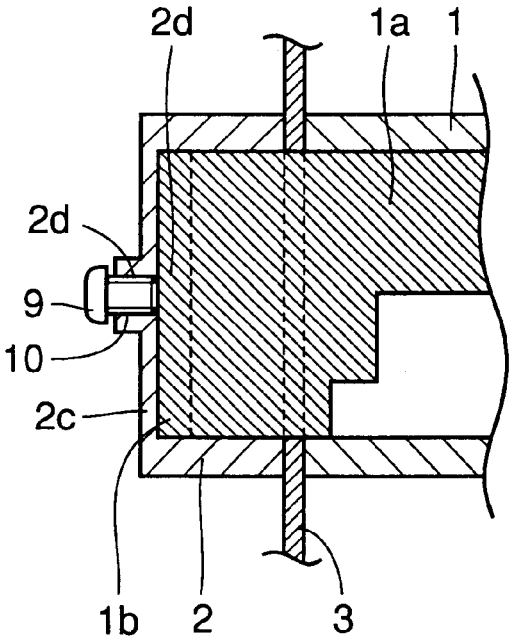
FIG. 8B is a partial, sectional view taken along a line VIIIB—VIIIB of FIG. 8A.

A polarized wave separator according to the seventh embodiment will now be described. Referring to FIGS. 8A, 8B and 8C, a groove 2*d* is formed on end surface portion 2*c* of wave reflecting unit 2 for receiving end portion 1*b* of partition wall 1*a* facing wave reflecting surface 2*a*. End portion 1*b* of partition wall 1*a* is inserted into groove 2*d*. On the outside of end surface portion 2*c* of wave reflecting unit 2, a tapped hole 10 is formed, in which a screw 9 is provided. A tip portion of screw 9 contacts end portion 1*b* of partition wall 1*a*.

Otherwise, the configuration of the polarized wave separator of the present embodiment is similar to that of the first embodiment shown in FIGS. 1 and 2, and therefore, same members are denoted by same reference characters and description thereof is not repeated.

According to the polarized wave separator of the present embodiment, the tip portion of screw 9 attached to end surface portion 2*c* of wave reflecting unit 2 contacts end portion 1*b* of partition wall 1*a*. Thus, connection and hence good conduction between partition wall 1*a* and wave reflecting unit 2 are ensured. Correspondingly, loss of the separated wave is reduced, wave-guiding spaces A and B are separated more reliably, so that escape of components of the transformed, linearly polarized wave from wave-guide space A to wave-guide space B, or vice versa, is prevented. As a result, the polarized wave-separating characteristics for microwave are further improved.

Eighth Embodiment

Figure 9B:
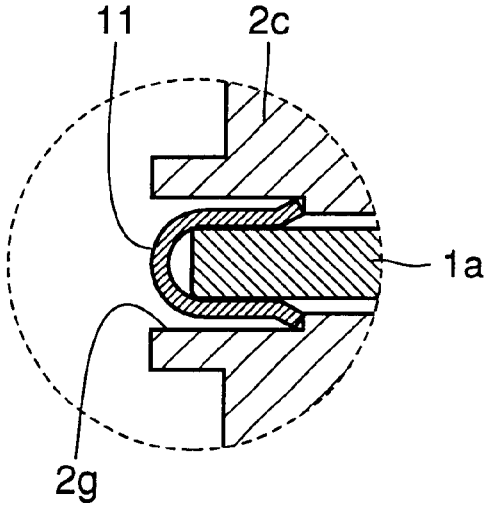
FIG. 9B is a partial, enlarged sectional view of the polarized wave separator of FIG. 9A.
Figure 9A:
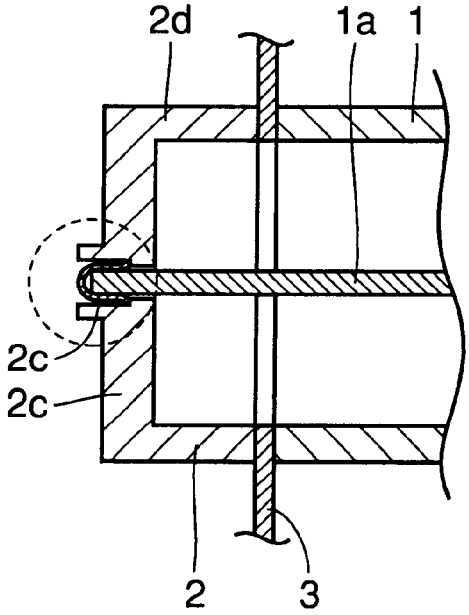
FIG. 9A is a partial, vertical sectional view of a polarized wave separator according to an eighth embodiment of the present invention.
Figure 9C:
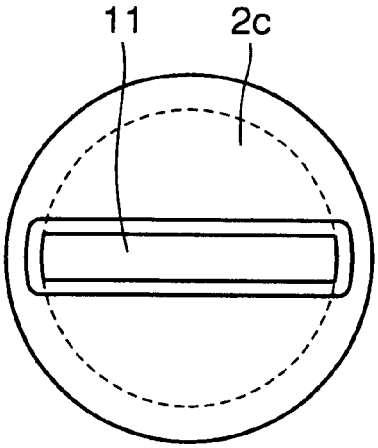
FIG. 9C is a side view of the polarized wave separator of FIG. 9A.

A polarized wave separator according to the eighth embodiment will now be described. Referring to FIGS. 9A, 9B and 9C, a slit 2*g* is formed on end surface portion 2*c* of wave reflecting unit 2. An end portion of partition wall 1*a* facing wave reflecting surface 2*a* is inserted into slit 2*g*. Provided between partition wall 1*a* and slit 2*g* is a spring 11, which is formed of sheet metal. Spring 11 is preferably in a plate shape formed of sheet metal of aluminum, tin, phosphor bronze or the like.

Otherwise, the configuration of the present embodiment is identical to that of the first embodiment shown in FIGS. 1 and 2, and therefore, same members are denoted by same reference characters and description thereof is not repeated.

According to the polarized wave separator of the present embodiment, spring member 11 is provided between partition wall 1*a* and slit 2*g* in wave reflecting unit 2. Thus, resilience of the spring member 11 ensures contact of partition wall 1*a* and wave reflecting unit 2, providing good conduction therebetween. Correspondingly, loss of the separated wave is reduced, and separation between wave-guiding spaces A and B is further ensured, thereby preventing escape of components of the transformed, linearly polarized wave from one wave-guiding space A or B to the other wave-guiding space B or A. As a result, the polarized wave-separating characteristics for microwave are further improved.

In addition, as the spring is easily mounted/dismounted, variation in assembling work is reduced, which helps improve the quality of the polarized wave separator. It is noted that, besides the plate spring as described above, any conductive member or resin having appropriate resilience can be employed in the present embodiment.

Ninth Embodiment

Figure 10B:
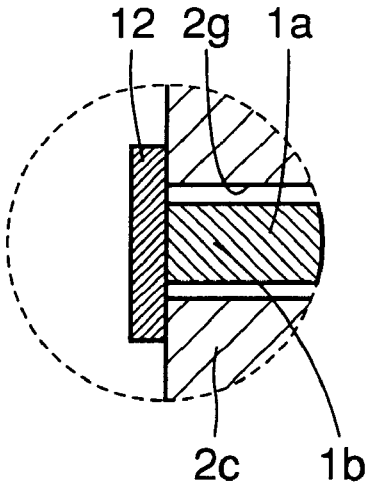
FIG. 10B is a partial, enlarged sectional view of the polarized wave separator of FIG. 10A.
Figure 10A:
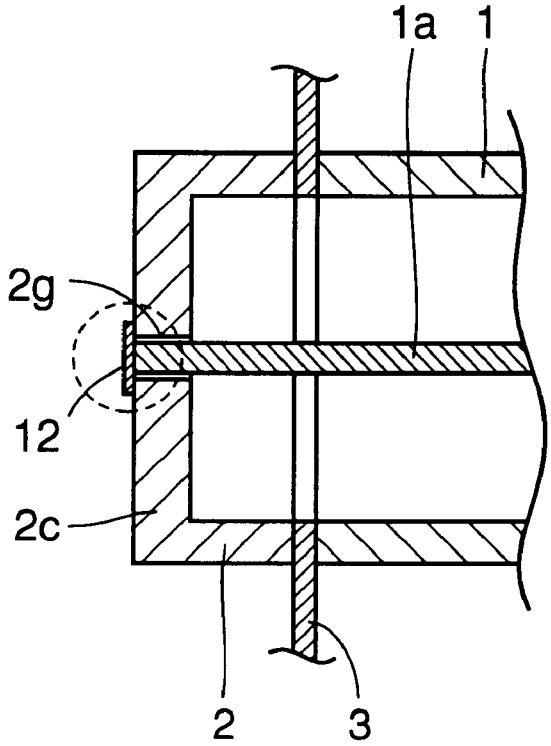
FIG. 10A is a partial, vertical sectional view of a polarized wave separator according to a ninth embodiment of the present invention.
Figure 10C:
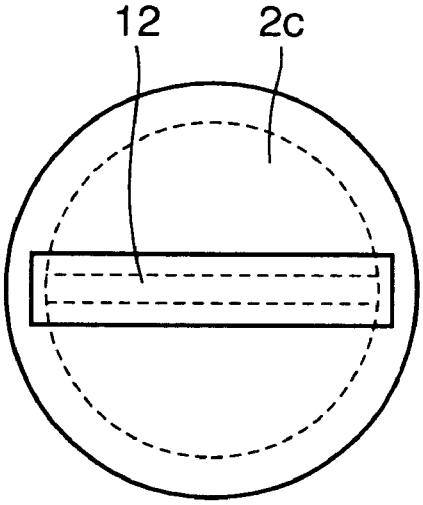
FIG. 10C is a side view of the polarized wave separator of FIG. 10A.

A polarized wave separator according to the ninth embodiment will now be described. Referring to FIGS. 10A, 10B and 10C, a slit 2*g* is formed on end surface portion 2*c* of wave reflecting unit 2 for receiving end portion 1*b* of partition 1*a* facing wave reflecting surface 2*a*. End portion 1*b* of partition wall 1*a* is inserted into this slit 2*g*, and is exposed at the outside of end surface portion 2*c*. The exposed end portion 1*b* of partition wall 1*a* and end surface portion 2*c* of wave reflecting unit 2 surrounding the exposed end portion 1*b* are continuously covered by a conductive film 12.

Otherwise, the configuration of the polarized wave separator of the present embodiment is similar to that of the first embodiment shown in FIGS. 1 and 2, and thus, same members are denoted by same reference characters and description thereof is not repeated.

According to the polarized wave separator of the present embodiment, the exposed end portion 1*b* of partition wall 1*a* and neighboring end surface portion 2*c* of wave reflecting unit 2 are continuously covered by conductive film 12. Thus, partition wall 1*a* and wave reflecting unit 2 are reliably contacted with each other via conductive film 12, thereby ensuring good conduction therebetween. Correspondingly, loss of the separated wave is reduced, and wave-guiding spaces A and B are separated from each other more reliably, so that components of the transformed, linearly polarized wave are prevented from escaping from one wave-guiding space A or B to the other wave-guiding space B or A. As a result, the polarized wave-separating characteristics for microwave are further improved.

Besides the conductive film as described above, metal foil with an adhesive applied thereon, for example, may be employed to attain the same effects.

Figure 11B:
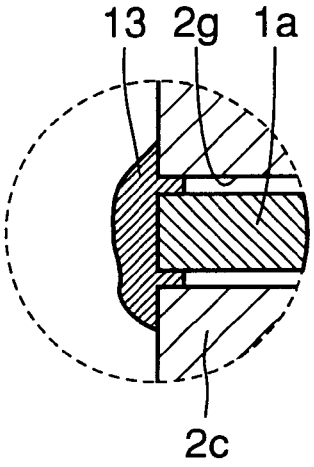
FIG. 11B is a partial, enlarged sectional view of the polarized wave separator of FIG. 11A.
Figure 11A:
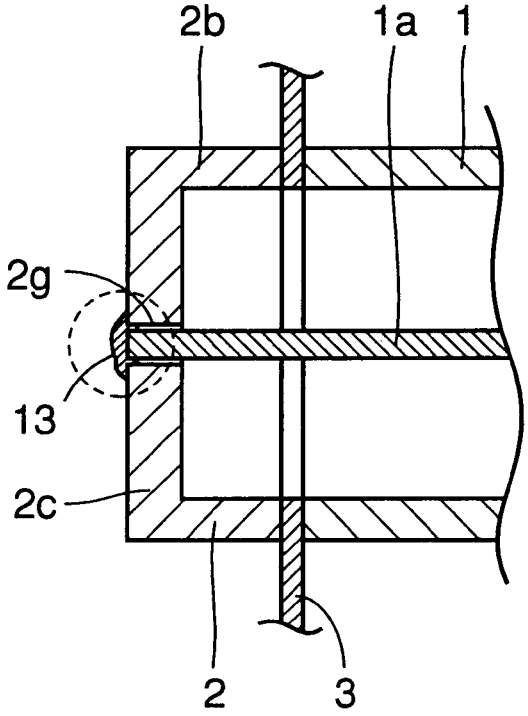
FIG. 11A is a partial, vertical sectional view of a modification of the polarized wave separator according to the ninth embodiment.
Figure 11C:
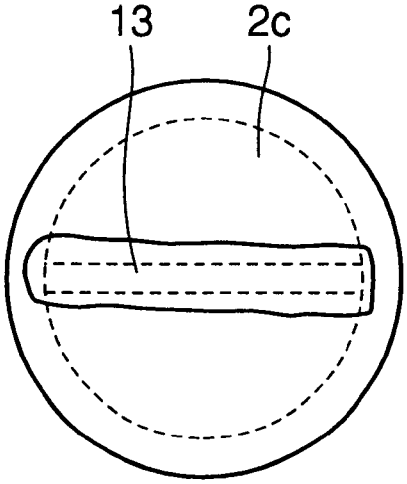
FIG. 11C is a side view of the polarized wave separator of FIG. 11A.

Further, as shown in FIGS. 11A, 11B and 11C, conductive paste or conductive glue 13 may be applied instead of conductive film 12 or metal foil. In this case, again, the same effects can be obtained.

Tenth Embodiment

Figure 12B:
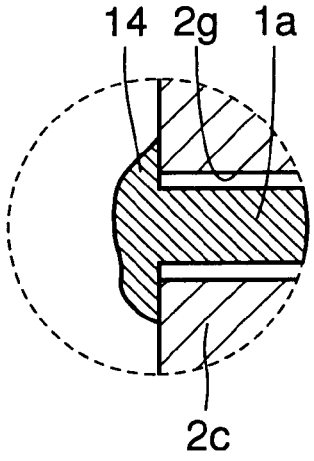
FIG. 12B is a partial, enlarged sectional view of the polarized wave separator of FIG. 12A.
Figure 12A:
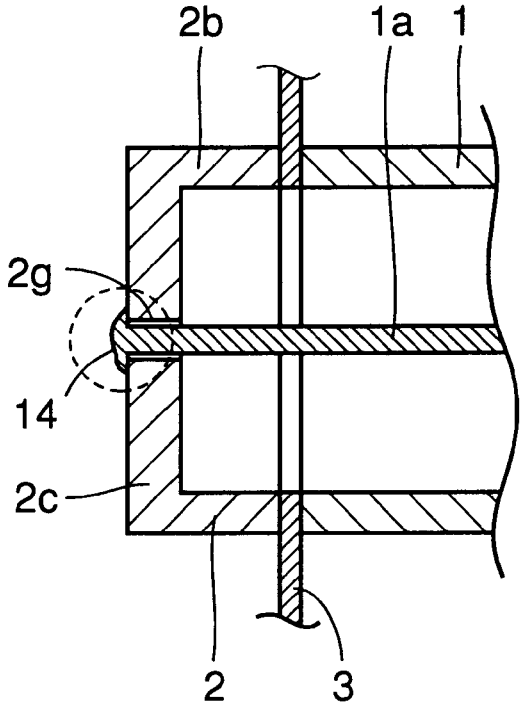
FIG. 12A is a partial, vertical sectional view of a polarized wave separator according to a tenth embodiment of the present invention.

A polarized wave separator according to the tenth embodiment will now be described. Referring to FIGS. 12A and 12B, a slit 2*g* is formed at end surface portion 2*c* of wave reflecting unit 2, and end portion 1*b* of partition wall 1*a* facing wave reflecting surface 2*a* is inserted into slit 2*g*. End portion 1*b* of partition wall 1*a* and end surface portion 2*c* surrounding the exposed end portion 1*b* are welded by ultrasonic welding or laser welding, so that a welded portion 14 is formed.

Figure 12C:
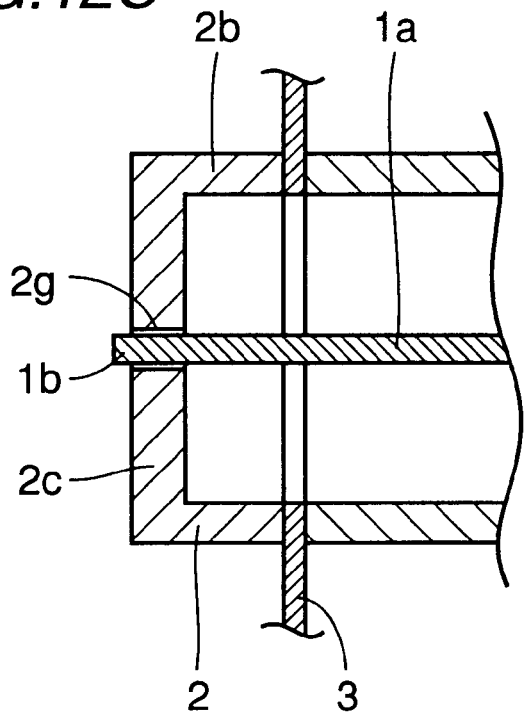
FIG. 12C is a partial, vertical sectional view of the polarized wave separator of FIG. 12A before formation of a welded portion.

Welded portion 14 is formed, as shown in FIG. 12C, by welding a portion of end portion 1*b* of partition 1*a* that was extended through slit 2*g* and protruded from end surface portion 2*c* to a portion of end surface portion 2*c* of wave reflecting unit 2 surrounding the protruded portion of end portion 1*b*. Here, ultrasonic welding or laser welding is employed.

Otherwise, the configuration of the polarized wave separator of the present embodiment is similar to that of the first embodiment as shown in FIGS. 1 and 2, and therefore, same members are denoted by same reference characters and description thereof is not repeated.

According to the polarized wave separator of the present embodiment, welded portion 14 is formed by welding end portion 1*b* of partition wall 1*a* and end surface portion 2*c* of wave reflecting unit 2 surrounding the protruded end portion 1*b*. Thus, partition wall 1*a* and wave reflecting unit 2 are reliably contacted, providing good conduction therebetween. Correspondingly, loss of the separated wave is reduced, and separation between wave-guiding spaces A and B is ensured, so that components of the transformed, linearly polarized wave are prevented from escaping from wave-guiding space A to wave-guiding space B or vice versa. As a result, the polarized wave-separating characteristics for microwave are further improved.

Eleventh Embodiment

Figure 13A:
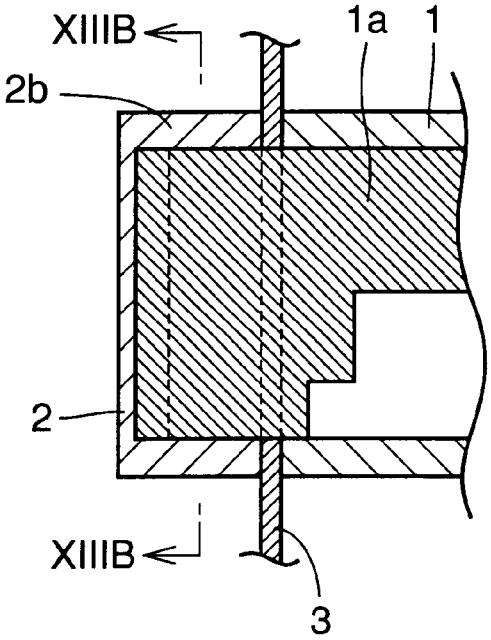
FIG. 13A is a partial, vertical sectional view of a polarized wave separator according to an eleventh embodiment of the present invention.
Figure 13B:
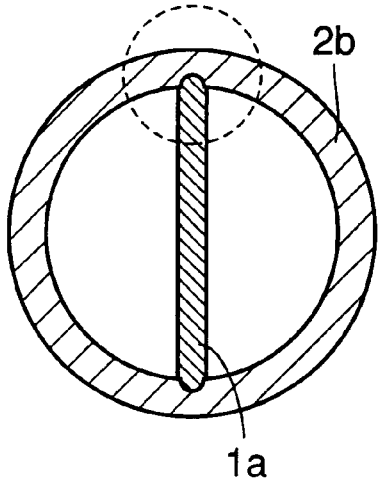
FIG. 13B is a partial, sectional view taken along a line XIIIB—XIIIB of FIG. 13A.
Figure 13C:
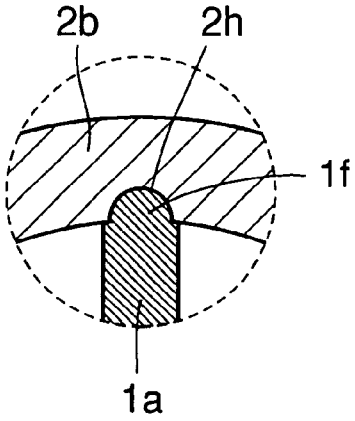
FIG. 13C is a partial, enlarged sectional view of the polarized wave separator of FIG. 13A.

A polarized wave separator according to the eleventh embodiment will now be described. Referring to FIGS. 13A, 13B and 13C, a convex portion if is formed at a portion of partition wall 1*a* contacting tubular portion 2*b* of wave reflecting unit 2, along a direction in which partition wall 1*a* extends. Similarly, a concave portion 2*h* is formed on the inner side of tubular portion 2*b*, so that the convex portion if of partition wall 1*a* is fitted into the concave portion 2*h*. At the end portion of partition wall 1*a* facing wave reflecting surface 2*a*, any of the structures described in the first through tenth embodiments is employed.

According to the polarized wave separator of the present embodiment, fitting of convex portion if of partition wall 1*a* into concave portion 2*h* of tubular portion 2*b* further ensures separation between wave-guiding spaces A and B. Thus, escape of components of the transformed, linearly polarized wave from one wave-guiding space A or B to the other wave-guiding space B or A is prevented more reliably. As a result, the polarized wave-separating characteristics for microwave are still further improved.

Figure 14A:
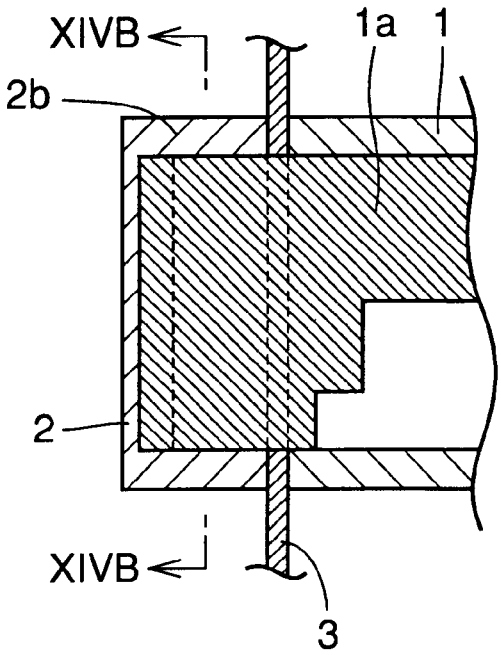
FIG. 14A is a partial, vertical sectional view of a modification of the polarized wave separator according to the eleventh embodiment.
Figure 14B:
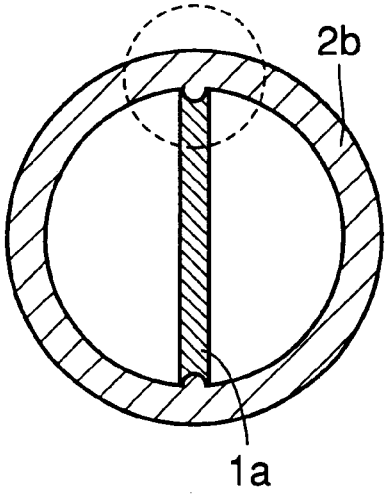
FIG. 14B is a partial, sectional view taken along a line XIVB—XIVB of FIG. 14A.
Figure 14C:
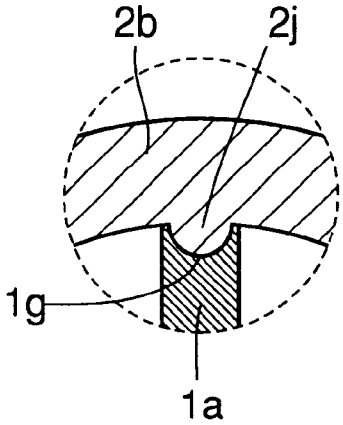
FIG. 14C is a partial, enlarged sectional view of the polarized wave separator of FIG. 14A.

Although partition wall 1*a* is provided with convex portion if and tubular portion 2*b* is provided with concave portion 2*h* in this embodiment, it is also possible to provide partition wall 1*a* with a concave portion 1 g and tubular portion 2*b* with a convex portion 2*j*, as shown in FIGS. 14A, 14B and 14C. In this case, again, the same effects can be obtained.

In addition, in each of the drawings illustrating the polarized wave separators of the respective embodiments, the internal diameters of waveguide 1 and tubular portion 2 are made substantially the same as the opening diameter of opening portion 3*a*. Alternatively, the opening diameter of opening portion 3*a* can be made smaller than the internal diameters of waveguide 1 and tubular portion 2, for example. The same effects can be obtained as long as the internal circumferences of waveguide, 1 and tubular portion 2 encircle the opening portion 3*a* successfully.

Twelfth Embodiment

Figure 15:
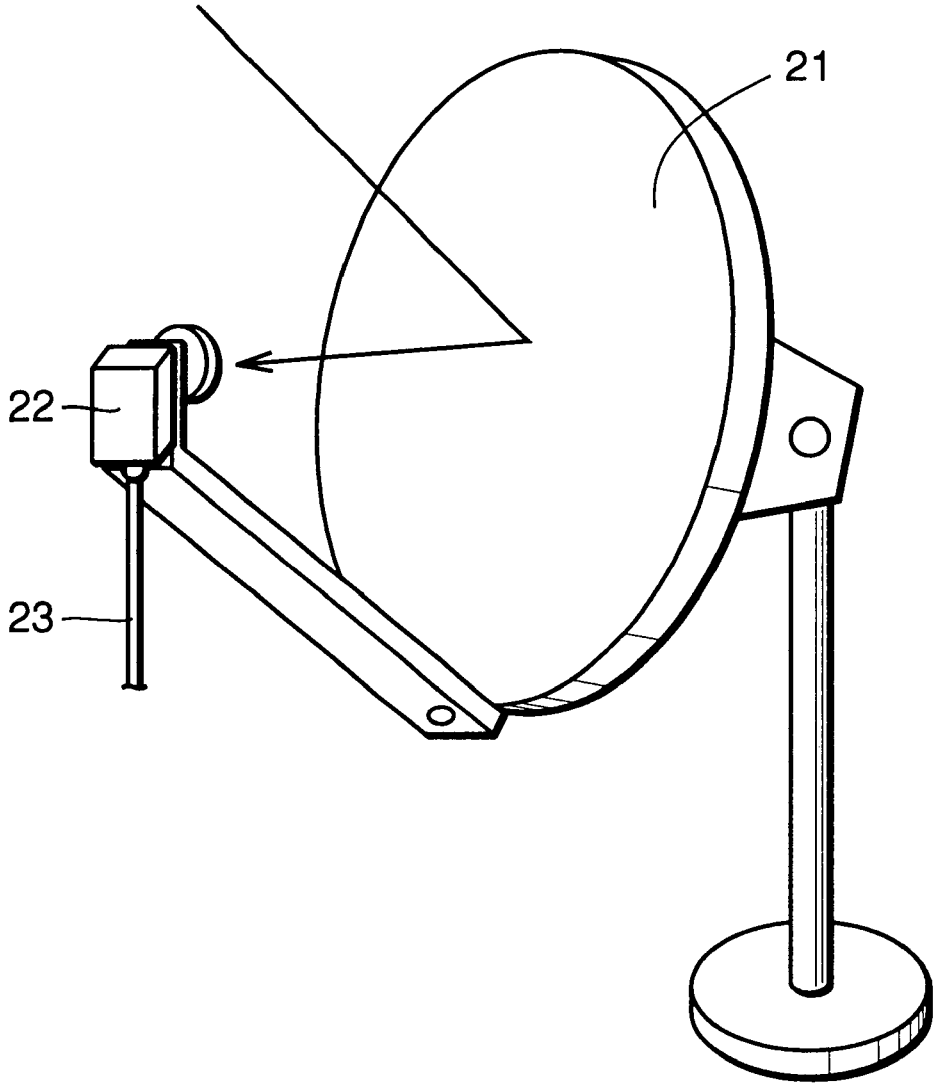
FIG. 15 is a perspective view of a parabolic antenna provided with a polarized wave separator according to a twelfth embodiment of the present invention.

A polarized wave separator according to the twelfth embodiment of the present invention will now be described. First, an example of a parabolic antenna provided with the polarized wave separator will be described. As shown in FIG. 15, the radio wave sent from a satellite is reflected and integrated by parabolic antenna 21, and received at a satellite broadcasting receiving converter body (hereinafter, simply referred to as "converter body") 22 that includes the polarized wave separator. The wave received at converter body 22 is sent via a cable 23 to domestic appliances (not shown).

Figure 16:
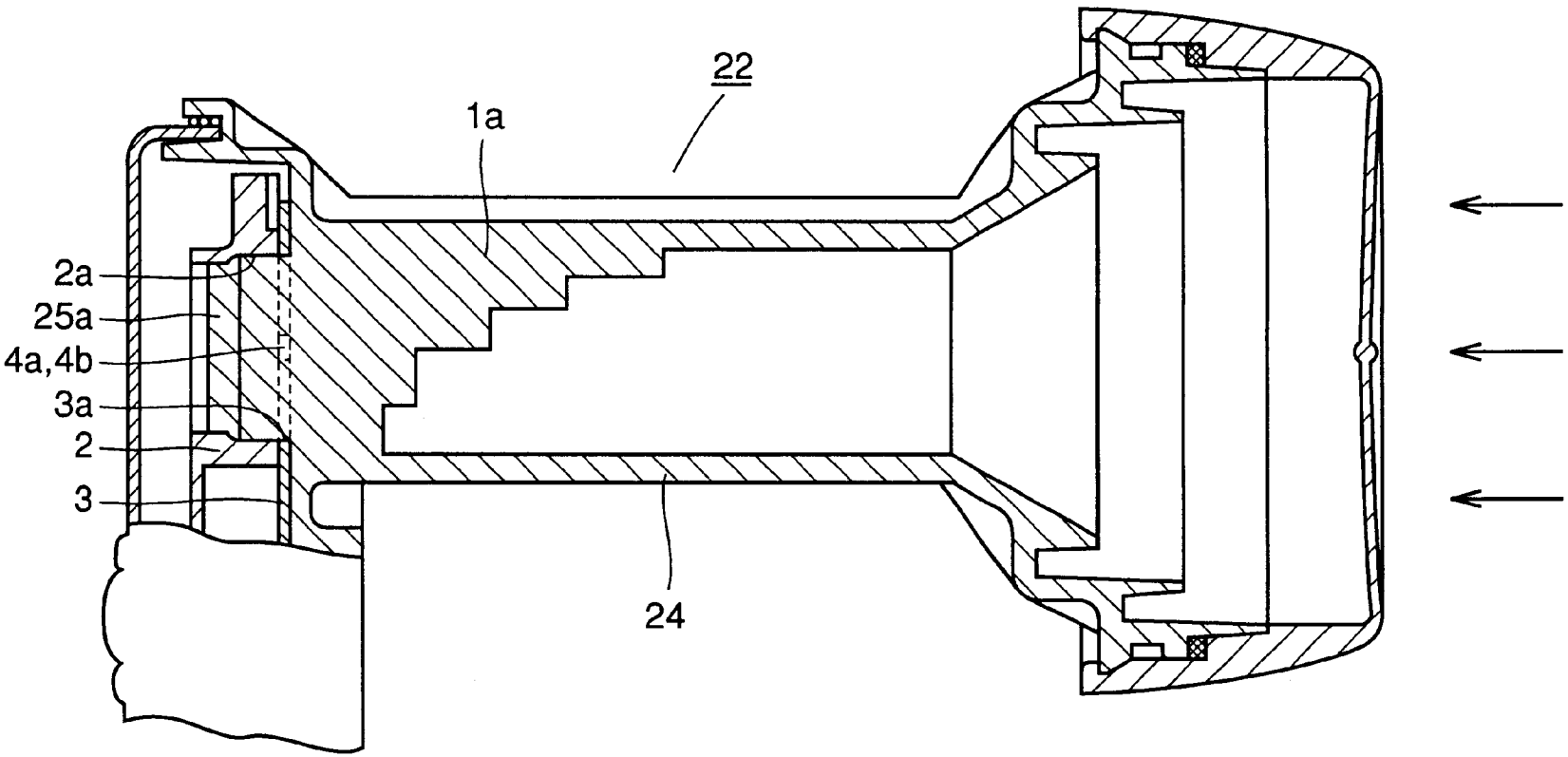
FIG. 16 is a sectional view of the polarized wave separator according to the twelfth embodiment.

Next, converter body 22 will be described. As shown in FIGS. 16 and 17C, converter body 22 includes a chassis with waveguide 24 having a partition wall 1*a* provided therein, and an electrically short-circuited plate (hereinafter, "short plate") 2 as a wave reflecting unit having a wave reflecting surface 2*a* provided therein. Partition wall 1*a* extends through an opening portion 3*a* provided at a substrate portion 3 to reach short plate 2. The end portion of partition wall 1*a* is received at a slit portion 2*k* formed on short plate 2. Herein, the short plate refers to a member that is electrically short-circuited with the waveguide for reflecting the radio wave coming into the waveguide to the opposite direction.

Figure 17A:
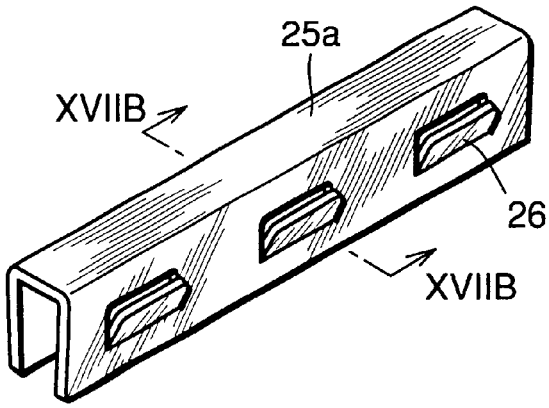
FIG. 17A is a perspective view of an earthed cap for use in the polarized wave separator according to the twelfth embodiment.
Figure 17B:
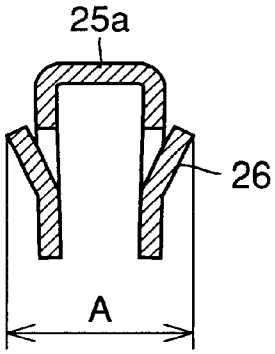
FIG. 17B is a sectional view taken along a line XVIIB—XVIIB of FIG. 17A.
Figure 17C:
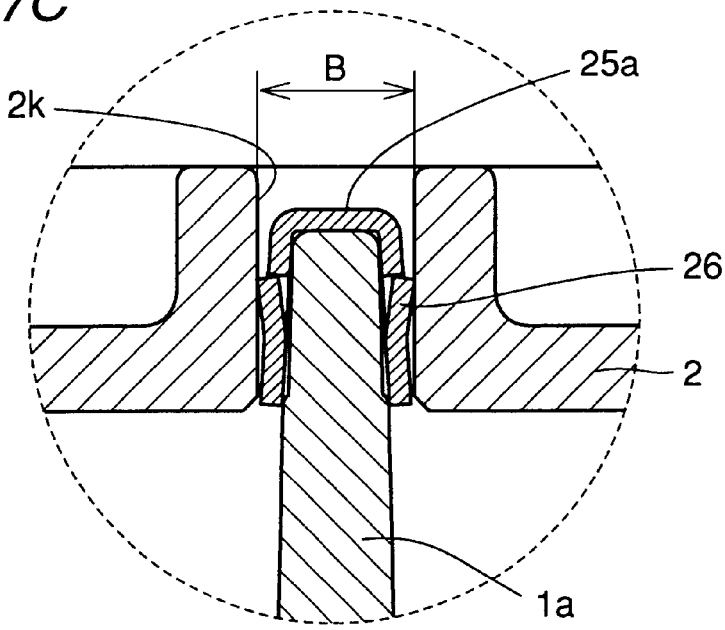
FIG. 17C is a sectional view illustrating a partition wall with the earthed cap of the twelfth embodiment being mounted in a slit.

A conductive-type earthed cap 25*a,* as shown in FIGS. 17A and 17B, is mounted between the end portion of partition wall 1*a* and slit portion 2*k*. Earthed cap 25*a* is configured to cover the end portion of partition wall 1*a,* and its side portion formed towards a direction in which partition wall 1*a* extends is provided with a cut and bent portion 26 which is cut and bent outwards.

As shown in FIGS. 17B and 17C, a width A of earthed cap 25*a* including the cut and bent portion 26 is set slightly greater than a spacing B of slit 2*k*.

Thus, with mounting the end portion of partition wall 1*a* in slit 2*k,* it becomes possible to prevent earthed cap 25*a* from falling off, while ensuring electrical conduction between short plate 2 and partition wall 1*a*.

As a result, loss of the separated wave is reduced, wave-guiding spaces A and B are electrically separated from each other more reliably, and escape of components of the transformed, linearly polarized wave from one wave-guiding space A or B to the other wave-guiding space B or A is suppressed. Accordingly, the polarized wave-separating characteristics for microwave are further improved.

Figure 18A:
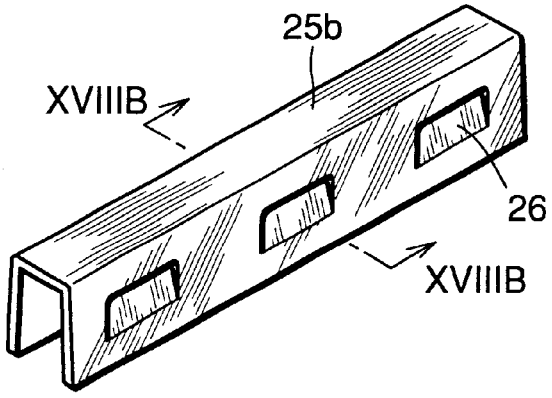
FIG. 18A is a perspective view of an earthed cap for use in the polarized wave separator according to a first modification of the twelfth embodiment.
Figure 18B:
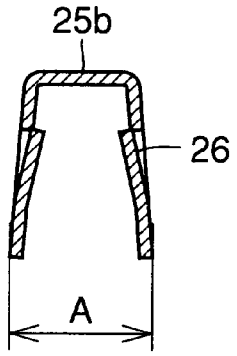
FIG. 18B is a sectional view taken along a line XVIIIB—XVIIIB of FIG. 18A.
Figure 18C:
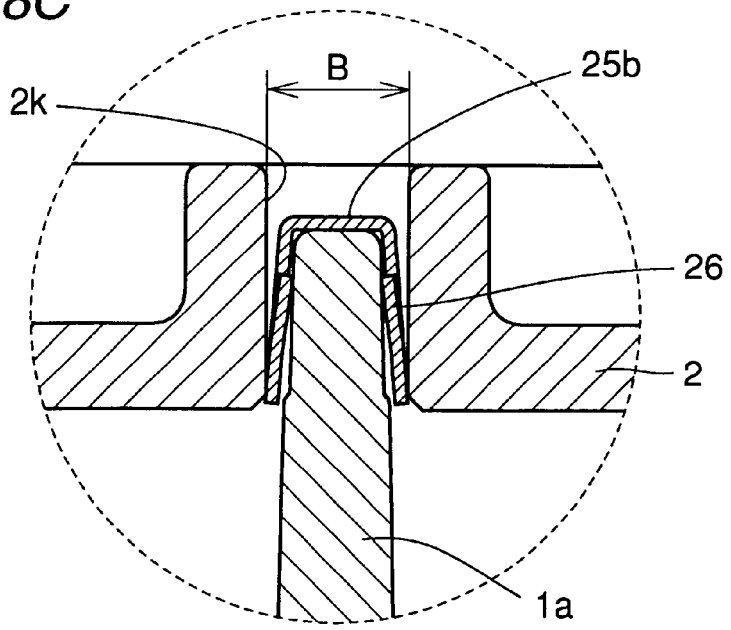
FIG. 18C is a sectional view illustrating a partition wall with the earthed cap of the first modification being mounted in a slit.

Next, a first modification of the earthed cap will be described. The earthed cap 25*b* according to the first modification, as shown in FIGS. 18A and 18B, has a portion 26 that is cut and bent inwards, specifically on its side portion formed towards the direction in which partition wall 1*a* extends. The width A of earthed cap 25*b* is set slightly greater than the width B of slit 2*k,* as shown in FIGS. 18B and 18C.

By this earthed cap 25*b,* again, when the end portion of partition wall 1*a* is mounted in slit 2*k,* it is possible to prevent detachment of earthed cap 25*a,* while ensuring electrical conduction between short plate 2 and partition wall 1*a* as the cut and bent portion 26 contacts partition wall 1*a*.

Further, as earthed cap 25*b* is mounted on the end portion of partition wall 1*a* before being inserted into slit 2*k* formed in short plate 2, efficiency of the assembling work improves. In addition, it is readily possible to confirm accurate positioning of earthed cap 25*b* upon assembling.

Figure 19A:
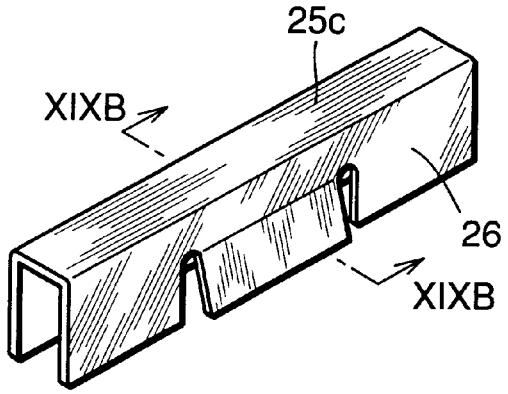
FIG. 19A is a perspective view of an earthed cap for use in the polarized wave separator according to a second modification of the twelfth embodiment.
Figure 19B:
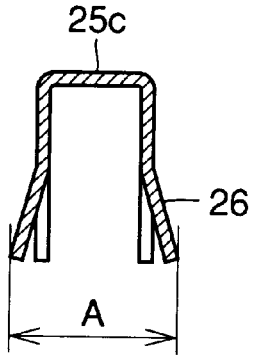
FIG. 19B is a sectional view taken along a line XIXB—XIXB of FIG. 19A.
Figure 19C:
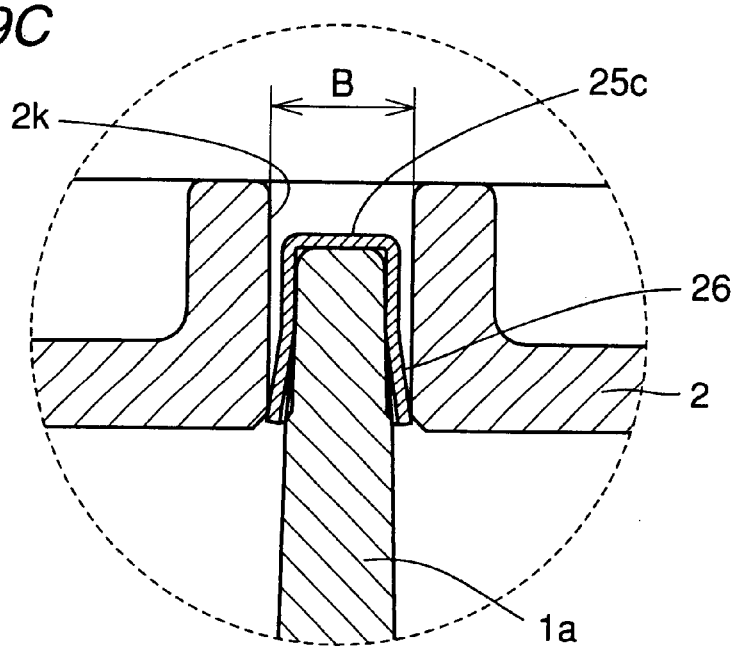
FIG. 19C is a sectional view illustrating a partition wall with the earthed cap of the second modification being mounted in a slit.

Next, a second modification of the earthed cap will be described. The earthed cap 25*c* according to the second modification, as shown in FIGS. 19A and 19B, has a portion 26 that is cut and bent outwards, specifically on its side portion formed towards the direction in which partition wall 1*a* extends. The width A of earthed cap 25*c* including cut and bent portion 26 is set slightly greater than the width B of slit 2*k,* as shown in FIGS. 19B and 19C.

With earthed cap 25*c* according to the second modification, again, when the end portion of partition wall 1*a* is mounted in slit 2*k,* earthed cap 25*c* is prevented from falling off, and electrical conduction between short plate 2 and partition wall 1*a* is ensured as the cut and bent portion 26 contacts short pate 2.

Further, like the earthed cap according to the first modification, earthed cap 25*c* can be mounted on the end portion of partition wall 1*a* before insertion into slit 2*k* formed in short plate 2. This improves efficiency of the assembling work, and simplifies confirmation of accurate positioning of earthed cap 25*c* when assembling.

Still further, earthed cap 25*c* according to the second modification can be manufactured at a lower cost than earthed cap 25*a* of the twelfth embodiment described first, since cut and bent portion 26 is made by cutting the side portion simply from its open end.

Figure 20A:
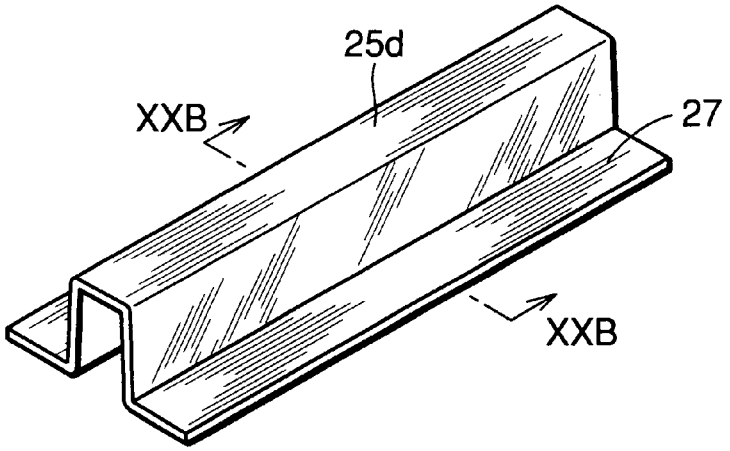
FIG. 20A is a perspective view of an earthed cap for use in the polarized wave separator according to a third modification of the twelfth embodiment.
Figure 20B:
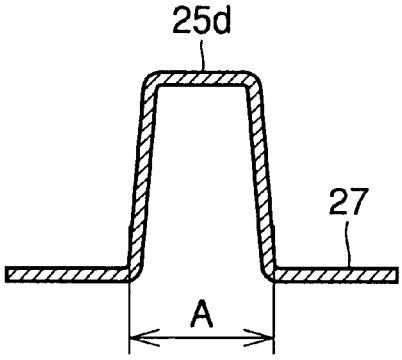
FIG. 20B is a sectional view taken along a line XXB—XXB of FIG. 20A.
Figure 20C:
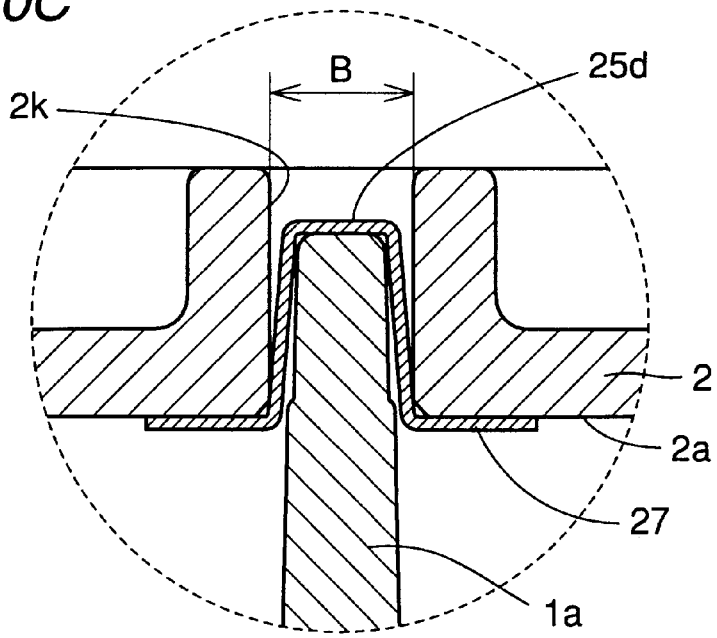
FIG. 20C is a sectional view illustrating a partition wall with the earthed cap of the third modification being mounted in a slit.

Next, a third modification of the earthed cap will be described. The earthed cap 25*d* according to the third modification, as shown in FIGS. 20A and 20B, has a hooked portion 27 which is formed such that it closely contacts wave reflecting surface 2*a* of short plate 2 face to face. The width A of earthed cap 25*d* excluding hooked portion 27 is set slightly greater than the width B of slit 2*k*.

Earthed cap 25*d* is first mounted in slit 2*k,* and then the end portion of partition wall 1*a* is inserted into the earthed cap 2*d* mounted in slit 2*k*. At this time, as width A is made slightly greater than width B, the partition wall and the short plate are fitted reliably, preventing displacement therebetween. Electrical conduction between short plate 2 and partition wall 1*a* is also ensured.

In addition, as hooked portion 27 of earthed cap 25*d* is secured on wave reflecting surface 2*a,* earthed cap 25*d* is prevented from moving or falling off upon or after assembling.

Figure 21A:
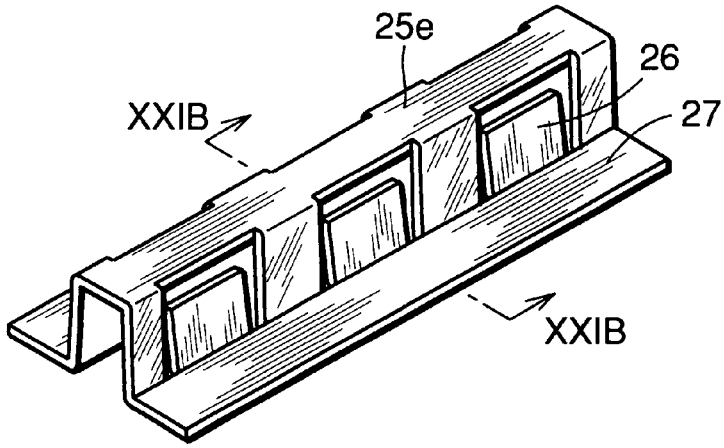
FIG. 21A is a perspective view of an earthed cap for use in the polarized wave separator according to a fourth modification of the twelfth embodiment.
Figure 21B:
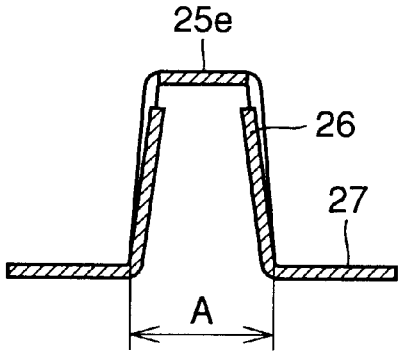
FIG. 21B is a sectional view taken along a line XXIB—XXIB of FIG. 21A.
Figure 21C:
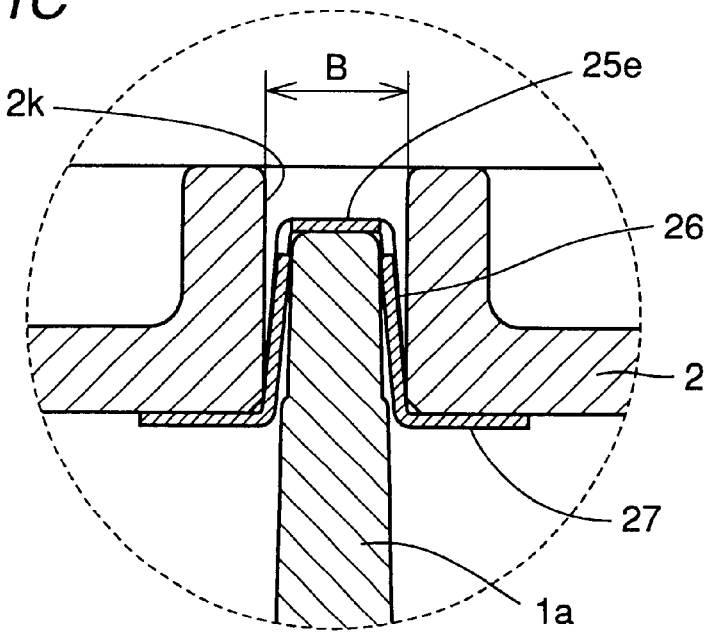
FIG. 21C is a sectional view illustrating a partition wall with the earthed cap of the fourth modification being mounted in a slit.

Next, a fourth modification of the earthed cap will be described. The earthed cap 25*e* according to the fourth modification, as shown in FIGS. 21A and 21B, has a hooked portion 27 formed such that it closely contacts wave reflecting surface 2*a* of short plate 2 face to face. It also has, on its side portion, a portion 26 cut and bent inwards. The width A of earthed cap 25*e* excluding hooked portion 27 is set slightly greater than the width B of slit 2*k*.

In addition to the effects obtained by earthed cap 25*d* of the third modification, earthed cap 25*e* of the fourth modification further ensures electrical conduction between short plate 2 and partition wall 1*a* because of the provision of cut and bent portion 26.

Figure 23:
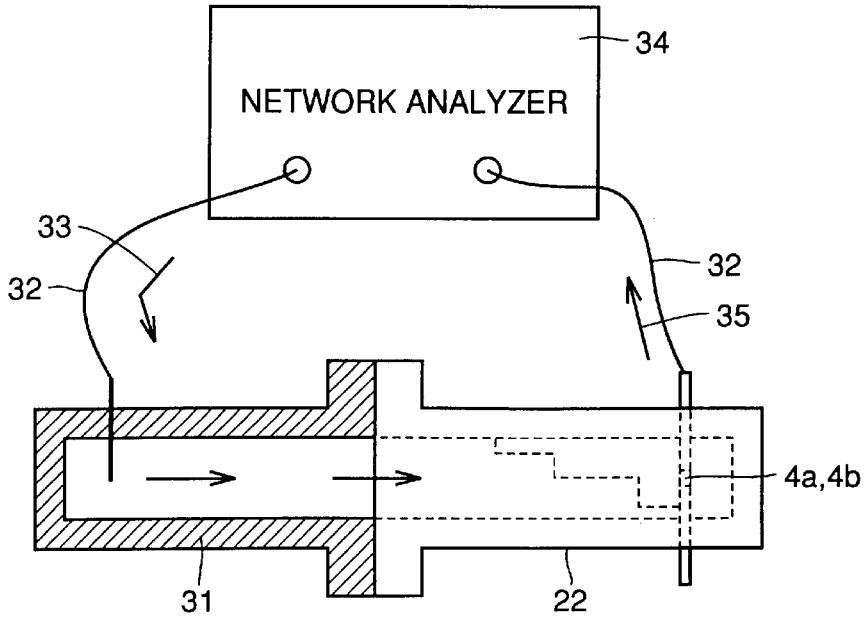
FIG. 23 illustrates how the wave loss is evaluated according to the twelfth embodiment.

Now, a result of evaluation in wave loss of the polarized wave separator provided with earthed cap 25*e* of the fourth modification will be described. The wave loss was evaluated using a network analyzer 34 as shown in FIG. 23. A waveguide 31 was attached to the wave incoming side of converter body 22, and an input signal was applied via a coaxial line 32 into waveguide 31. A passing signal traveling through waveguide 31 to converter body 22 and received at wave receiving probes 4*a,* 4*b* was detected by network analyzer 34.

Comparative evaluation of wave loss was then made based on the strength of passing signal 35 with respect to the strength of input signal 33 of a prescribed working frequency band. For example, with the strength of the input signal being represented as 1, if the strength of the passing signal is 0.5, then the wave loss is determined as: 10 log (0.5)=−3 (db).

Figure 22:
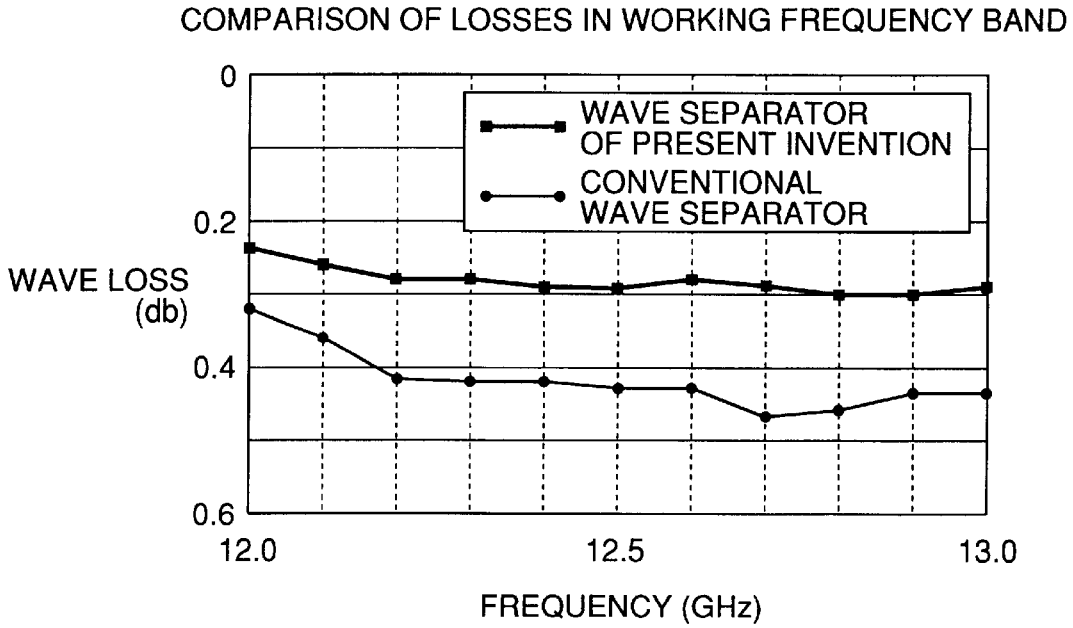
FIG. 22 is a graph for evaluation of wave losses in the polarized wave separator according to the fourth modification of the twelfth embodiment and in a conventional polarized wave separator.

FIG. 22 shows the evaluation result. As shown in FIG. 22, it was found that the wave loss by the polarized wave separator according to the present invention (expressed with ●) was reduced compared to that of a conventional polarized wave separator (■).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A polarized wave separator, comprising:

a substrate portion having an opening portion;

a pair of wave receiving portions formed on said substrate portion on opposite sides of said opening portion;

a waveguide located on one side of said substrate portion and having a partition wall portion within; and a wave reflecting unit located on another side of said substrate portion and having a wave reflecting surface formed inside the wave reflecting unit, said waveguide, said substrate portion and said wave receiving unit forming a wave-guiding space, said partition wall portion penetrating said opening portion and extending to said wave reflecting unit to divide said wave reflecting surface into two, and said partition wall portion partitioning said wave-guiding space into two wave-guiding spaces, one wave-guiding space having one of said pair of wave receiving portions located therein and another wave-guiding space having another one of said pair of wave receiving portions located therein.

2. The polarized wave separator according to claim 1, wherein said waveguide is placed such that an internal circumference of said waveguide encircles said opening portion, said wave reflecting unit includes a tubular portion located at a position opposite to said waveguide on the other side of said substrate portion, and an end surface portion located at an end of said tubular portion and having said wave reflecting surface formed therein, and said partition wall portion is electrically connected to said wave reflecting unit by contacting at least said end surface portion.

3. The polarized wave separator according to claim 2, wherein an end portion of said partition wall portion facing said wave reflecting surface is in a convex shape, and said end portion of the convex shape contacts said wave reflecting surface.

4. The polarized wave separator according to claim 2, wherein a groove portion is formed on an inner side of said end surface portion, and an end portion of said partition wall portion facing said wave receiving surface is received at said groove portion.

5. The polarized wave separator according to claim 4, wherein said end portion of said partition portion is formed in either one of a saw-tooth waveform and a waveform, and said groove portion is formed to correspond to the form of said end portion.

6. The polarized wave separator according to claim 2, having a female screw portion provided on said end surface portion, and a male screw portion attached to the female screw portion, said male screw portion contacting said partition wall portion.

7. The polarized wave separator according to claim 2, wherein said end surface portion is provided with a slit portion formed to penetrate said end surface portion, and an end portion of said partition wall portion facing said wave reflecting surface is inserted into said slit portion.

8. The polarized wave separator according to claim 7, wherein said end portion of said partition wall portion penetrates said slit portion and is riveted at an outside of said end surface portion.

9. The polarized wave separator according to claim 7, wherein a conductive member is mounted between said end portion of said partition wall portion and said slit portion.

10. The polarized wave separator according to claim 9, wherein said conductive member includes one of an elastic body and a resin.

11. The polarized wave separator according to claim 7, wherein said end portion of said partition wall portion penetrates said slit portion and is exposed outside said end surface portion, and a conductive member is formed to directly cover said end surface portion and said end portion exposed.

12. The polarized wave separator according to claim 11, wherein said conductive member includes any of conductive film, metal foil, conductive paste and conductive adhesive.

13. The polarized wave separator according to claim 7, wherein said end portion of said partition wall portion penetrates said slit portion and is exposed outside said end surface portion, and said end surface portion and said end portion exposed are welded.

14. The polarized wave separator according to claim 2, wherein said partition wall portion contacts said tubular portion, and at a position where said tubular portion and said partition wall portion contact to each other, one of said tubular portion and said partition wall portion is provided with a concave portion formed along a direction in which said partition wall portion extends, and the other of said tubular portion and said partition wall portion is provided with a convex portion to fit into said concave portion.

15. The polarized wave separator according to claim 7, comprising a conductive earthed cap portion mounted to cover said end portion of said partition wall portion and interposed between said partition wall portion and said slit portion.

16. The polarized wave separator according to claim 15, wherein said earthed cap portion includes a side portion formed towards a direction in which said partition wall portion extends, and a cut and bent portion provided on said side portion and bent towards either one of said slit portion and said partition wall portion.

17. The polarized wave separator according to claim 15, wherein said earthed cap portion includes a hooked portion which closely contacts said wave reflecting surface of said end surface portion.

* * * * *